US006217274B1

(12) United States Patent
Svyatsky et al.

(10) Patent No.: US 6,217,274 B1
(45) Date of Patent: Apr. 17, 2001

(54) CONTINUOUS FLOW TRANSFER SYSTEM

(75) Inventors: Eduard Svyatsky, Libertyville; David Schwaba, Chicago; Anatoly Estis, Morton Grove; Walter Conard, Lake Villa; James Carl McClain, Chicago; Stephen R. Archer, Des Plaines; Fred Hegland, Lake Zurich, all of IL (US)

(73) Assignee: Bell & Howell Postal Systems, Inc., Lincolnwood, IL (US)

( * ) Notice: Subject to any disclaimer, the term of this patent is extended or adjusted under 35 U.S.C. 154(b) by 0 days.

(21) Appl. No.: 09/234,239

(22) Filed: Jan. 20, 1999

(51) Int. Cl.[7] ..... B65G 47/248

(52) U.S. Cl. ..... 414/405; 414/404; 198/408; 198/465.1

(58) Field of Search ..... 414/404, 405, 414/759, 773, 782; 198/408, 465.1

(56) References Cited

U.S. PATENT DOCUMENTS

| | | | | |
|---|---|---|---|---|
| 4,141,193 | * | 2/1979 | Joa | 198/408 X |
| 4,162,723 | * | 7/1979 | Kupper | 198/465.1 |
| 4,768,641 | * | 9/1988 | Hibi et al. | 198/408 X |
| 4,874,281 | * | 10/1989 | Bergerioux et al. | 414/404 X |
| 5,044,877 | * | 9/1991 | Constant et al. | 198/465.1 X |
| 5,058,726 | * | 10/1991 | Merritt | 198/408 X |
| 5,772,383 | * | 6/1998 | Kalika et al. | 414/773 X |

FOREIGN PATENT DOCUMENTS

| | | |
|---|---|---|
| WO 97/36523 | 10/1997 | (WO) . |
| WO 97/36696 | 10/1997 | (WO) . |
| WO 97/36788 | 10/1997 | (WO) . |
| WO 97/36804 | 10/1997 | (WO) . |

* cited by examiner

*Primary Examiner*—James W. Keenan
(74) *Attorney, Agent, or Firm*—Patula & Associates P.C.

(57) ABSTRACT

The present invention provides for a continuous flow transfer system designed to transfer the contents of a mail tray into a cartridge for subsequent processing and then, after processing, to transfer the contents of the cartridge back into a mail tray without disrupting the facing or orientation of each piece of mail. The continuous flow transfer system comprises both a cartridge loader and a cartridge unloader, both of which have a tray section, a transfer conveyor and a cartridge section. The tray section, or infeed section, of the cartridge loader is designed to deliver filled mail trays to the transfer section of the loader. At the transfer section, the contents of each mail tray are deposited into an intermediate container that is affixed to the transfer section. The transfer section then delivers the contents of the intermediate container into empty cartridges being fed onto the cartridge section, or discharge section, of the loader. Once filled, each cartridge is then transported away from the cartridge loader for processing, where the mail is removed from each container, processed and place back into a cartridge. After processing, the filled cartridges are then delivered to the cartridge section, or infeed section, of the cartridge unloader. Similar to the loader, the contents of each cartridge are transferred into an intermediate container affixed to the transfer section. The transfer section then delivers the contents of the intermediate container to the mail section, or discharge section, of the unloader, where the mail is transferred back into mail trays. The filled mail trays are then ready for delivery.

23 Claims, 35 Drawing Sheets

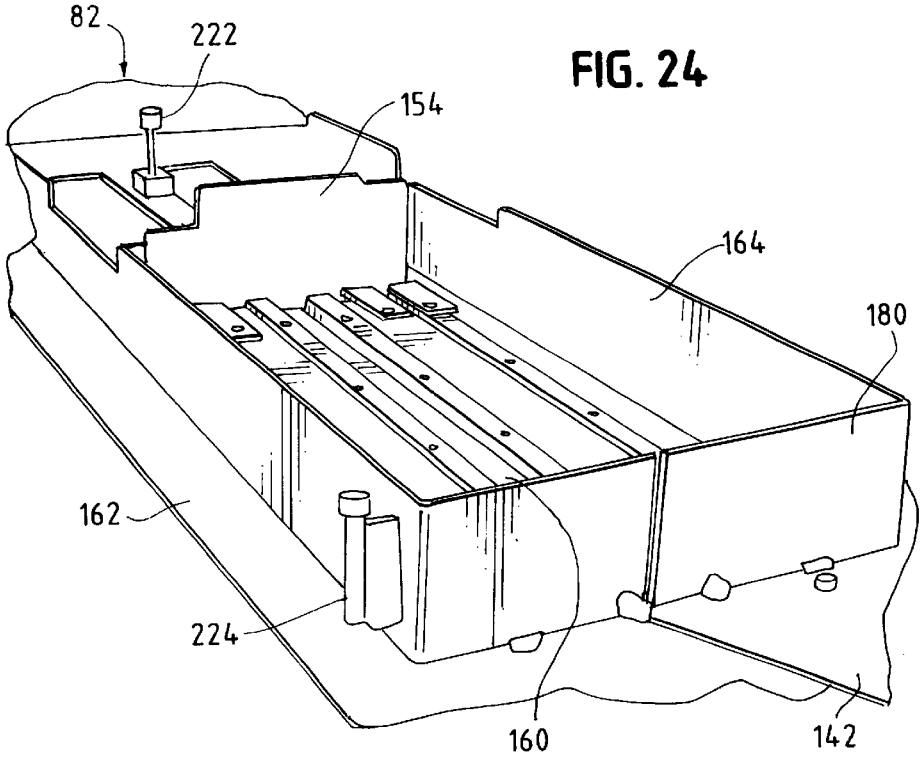
FIG. 24
FIG. 25
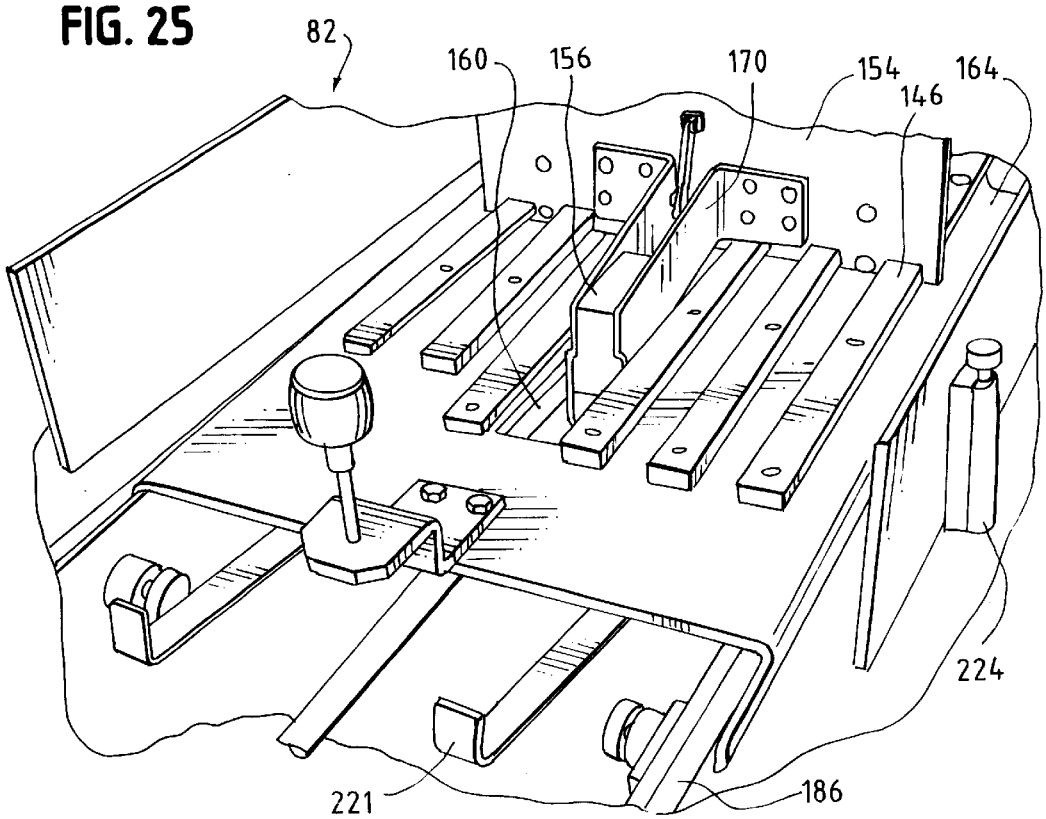

CONTINUOUS FLOW TRANSFER SYSTEM

FIELD OF THE INVENTION

The present invention relates to mail handling equipment for rapidly processing mail, and in particular to an automated continuous flow transfer system for transferring the mail pieces contained within plastic or cardboard mail trays into cartridges for processing and then transferring the processed mail pieces contained within the cartridges back into mail trays for subsequent delivery.

BACKGROUND OF THE INVENTION

Although the present invention may be used in connection with other applications, the present invention was designed for automated mail handling. Currently, mail is typically transported in flexible plastic or cardboard trays. As such, these trays do not always interface well with certain processing operations, and in particular, fully automated processing operations. To have a fully automated processing operation, it has become desirable to develop a machine or system that automatically transfers the contents of the mail trays into sturdy cartridges of uniform size and weight specially designed for interfacing with a given processing operation. Then, once the mail is processed, the machine or system would transfer the contents of the cartridges back into the mail trays for transport to delivery points. The automated mail transfer system must also have the ability to maintain the facing, orientation and order of each mail piece throughout the transfer process as to not disturb the mail processing procedure.

Accordingly, the present invention provides a unique automated continuous transfer system that provides for the transfer of mail from a mail tray into a specially designed cartridge and then, after processing, for transferring the mail from the cartridges back into the mail trays or other mail containers, without disturbing the facing and orientation of each mail piece.

SUMMARY OF THE INVENTION

The primary object of the present invention is to provide an automated device for loading and unloading mail trays of various sizes into and out of cartridges specifically designed to interface with certain mail processing operations.

Another object of the present invention is to provide a transfer apparatus that maintains the mail facing and orientation throughout the transfer process.

Yet another object of the present invention is to provide a mail transfer apparatus that transfers mail pieces from a mail tray to a cartridge and back into a mail tray with minimal loss or damage to each mail piece.

Still another object of the present invention is to provide a mail transfer apparatus that provides for smooth exchange of content.

A further object of the present invention is to provide a mail transfer apparatus having the capability of dividing mail contained within a completely filled mail tray and placing that mail into two separate cartridges, if necessary for further processing.

In accordance with these and other objects, the present invention provides a continuous flow transfer system for transferring the contents of a mail tray into a cartridge for processing and then transferring the contents of the cartridge back into a mail tray, subsequent to processing of the mail without disrupting the order, facing or orientation of the contents of the mail. The continuous flow transfer system comprises both a cartridge loader and a cartridge unloader. Both the cartridge loader and the cartridge unloader are comprised of a tray section, a transfer conveyor and a cartridge section.

The tray section, or infeed section, of the cartridge loader is designed to deliver loaded mail trays to the transfer section of the loader where the contents of each mail tray are then deposited into an intermediate container that is affixed to the transfer section The transfer section then delivers the contents of the intermediate container into empty cartridges being supplied by the cartridge section. Once filled, each cartridge then exits the cartridge section, or discharge section, of the cartridge loader. The cartridges are transported to an intermediary processing operation where the mail is removed from the cartridges for processing. Once processed, the mail is re-deposited into cartridges, and each cartridge is then delivered to the cartridge unloader by the cartridge section, or input section, of the cartridge unloader. The contents of each cartridge are then transferred into an intermediate container that is affixed to the transfer section of the cartridge unloader. The transfer section then delivers the contents of the intermediate container back into mail trays for further transport and delivery. Once in the mail trays, the filled mails trays then exit the tray section, or discharge section, of the cartridge unloader. The filled mail trays are then transported to an area for subsequent delivery.

As seen in the attached figures, the transfer section of both the loader and unloader is interposed between the tray section and cartridge section to maintain the order, facing and orientation of the mail pieces within the trays and cartridges. In the case of the loader, the transfer section may be designed to divide the contents of a mail tray for deposit into two cartridges, when necessary.

BRIEF DESCRIPTION OF THE DRAWINGS

FIG. 24 is a front perspective view of the intermediate container of the present invention designed to divide a single mail stack into two separate parts.

FIG. 25 is a rear perspective view of the intermediate container illustrated in FIG. 24.

DETAILED DESCRIPTION OF THE ILLUSTRATED EMBODIMENTS

Figure 1:
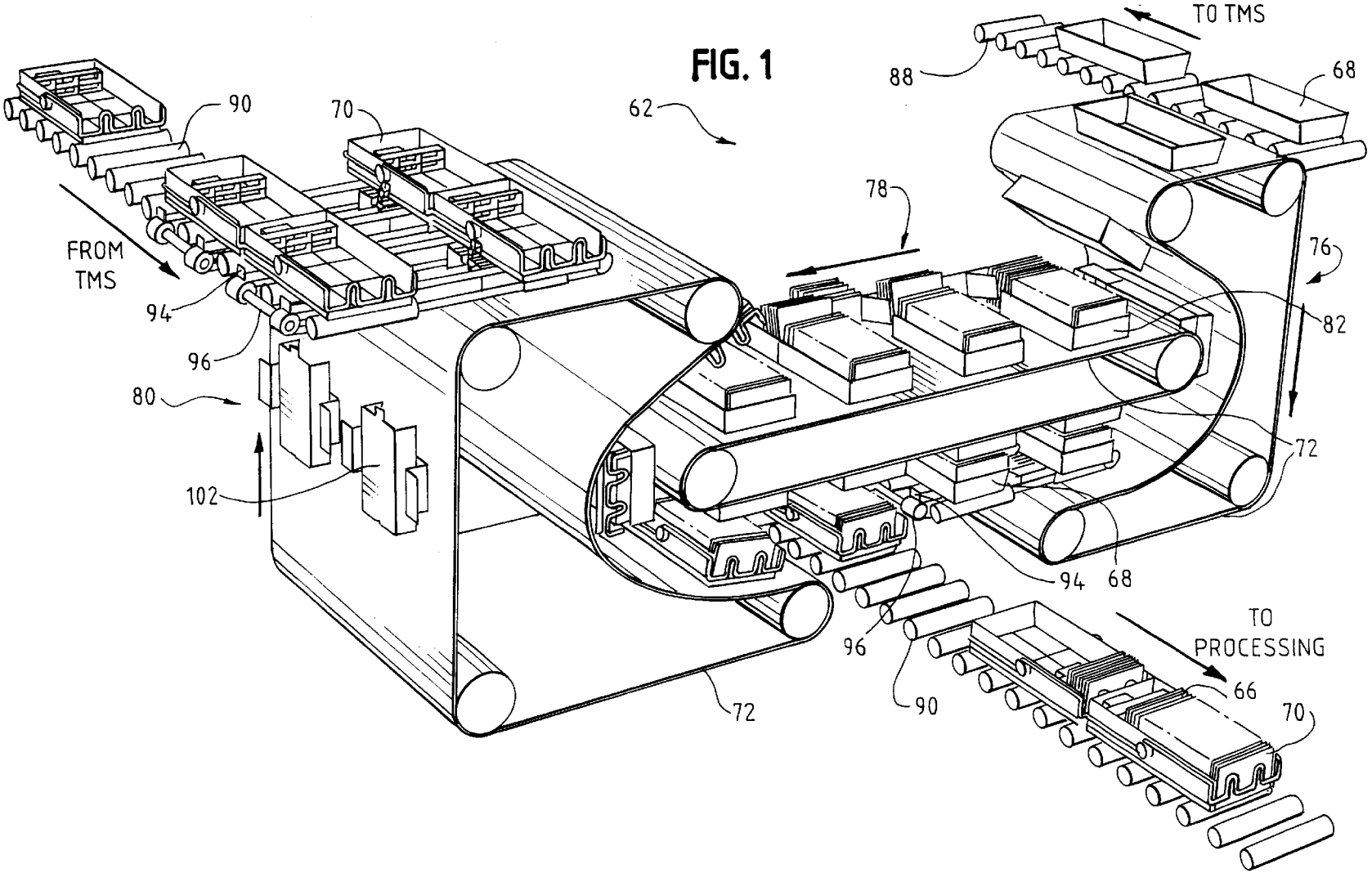
FIG. 1 is a front perspective view of one embodiment of the cartridge loader of the present invention utilizing a powered flat belt conveyor system.
Figure 2:
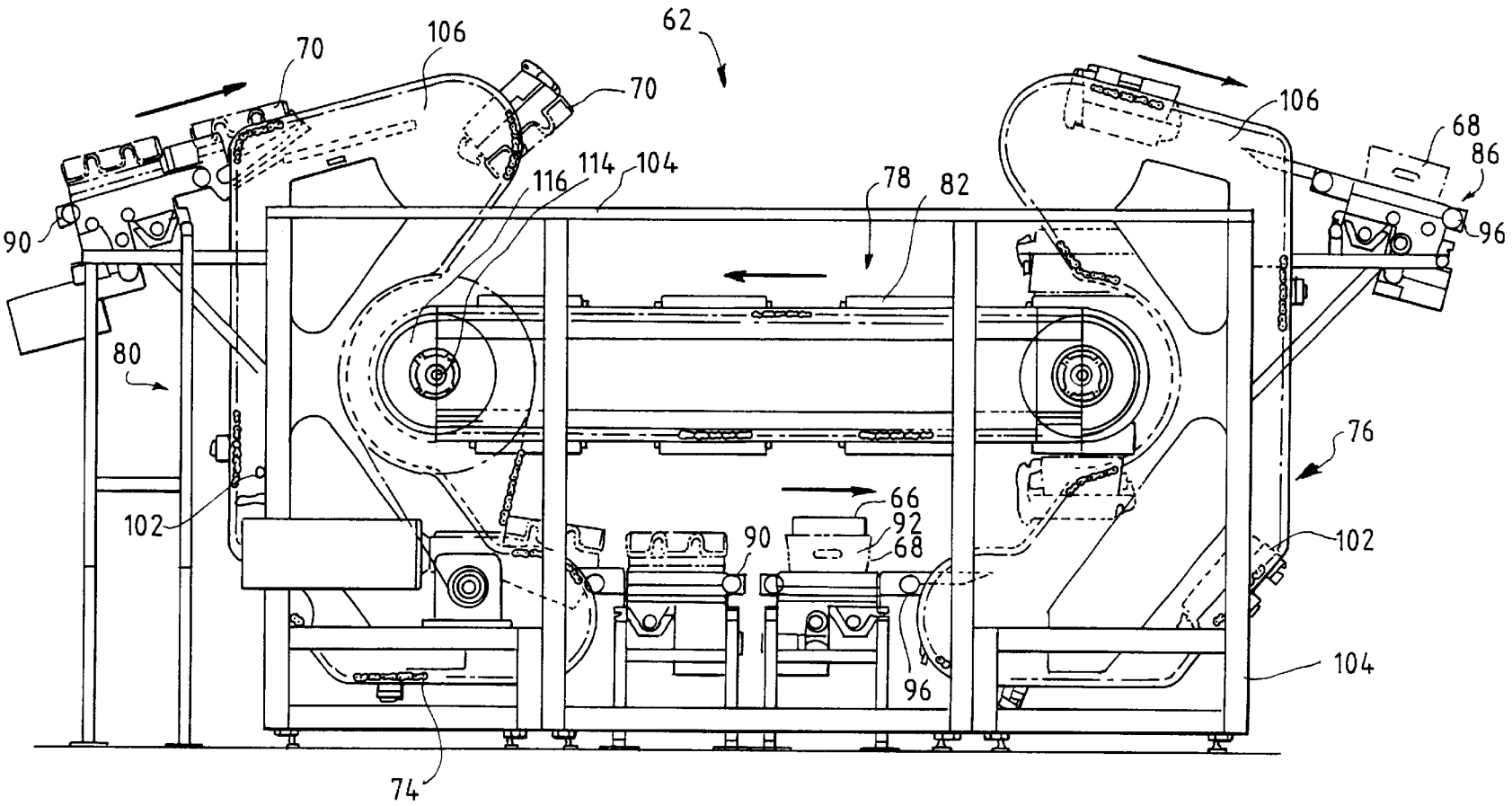
FIG. 2 is a side view of another embodiment of the cartridge loader of the present invention utilizing a powered chain conveyor system.
Figure 3:
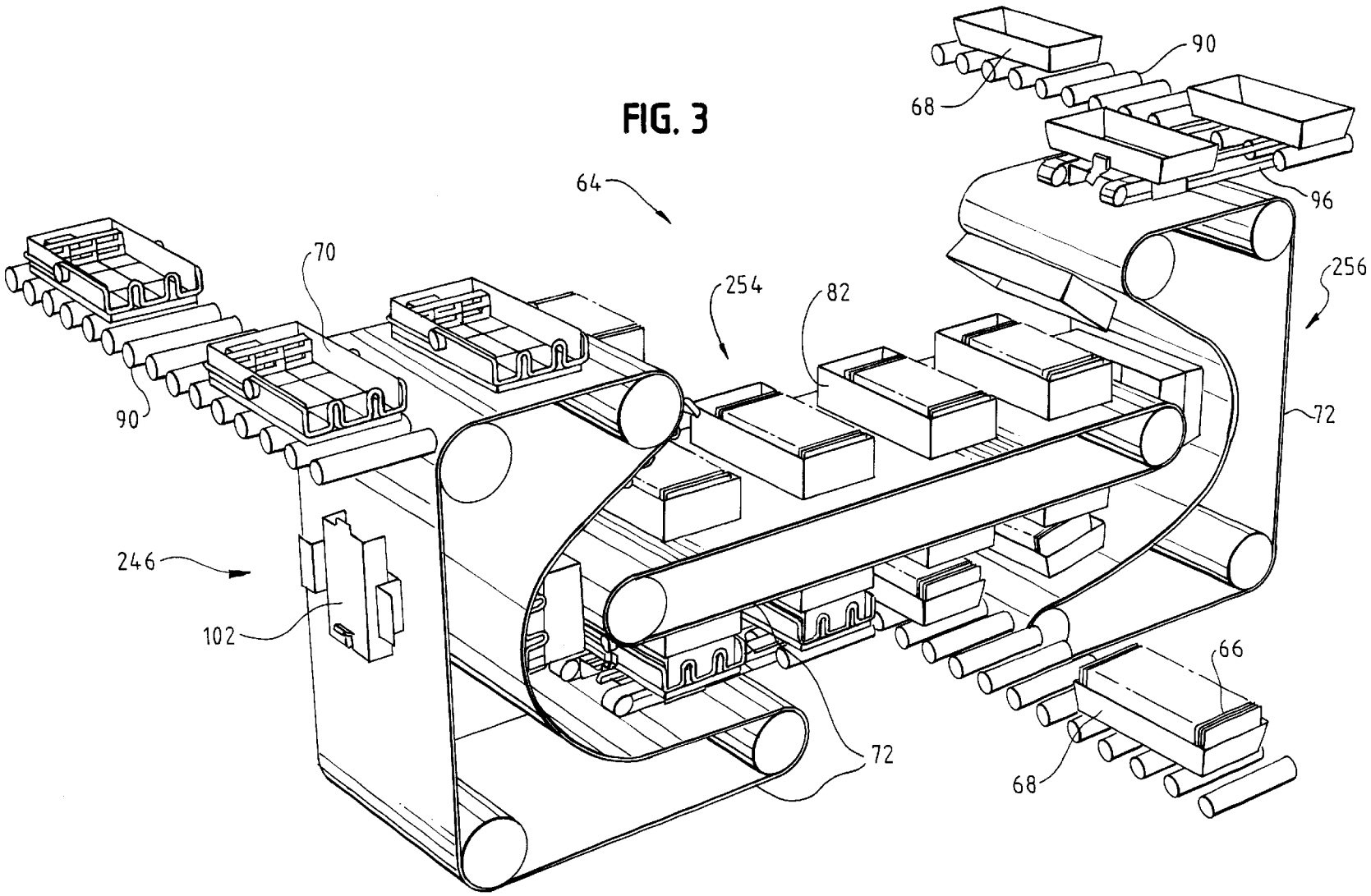
FIG. 3 is a front perspective view of one embodiment of the cartridge unloader of the present invention utilizing a powered flat belt conveyor system.
Figure 54:
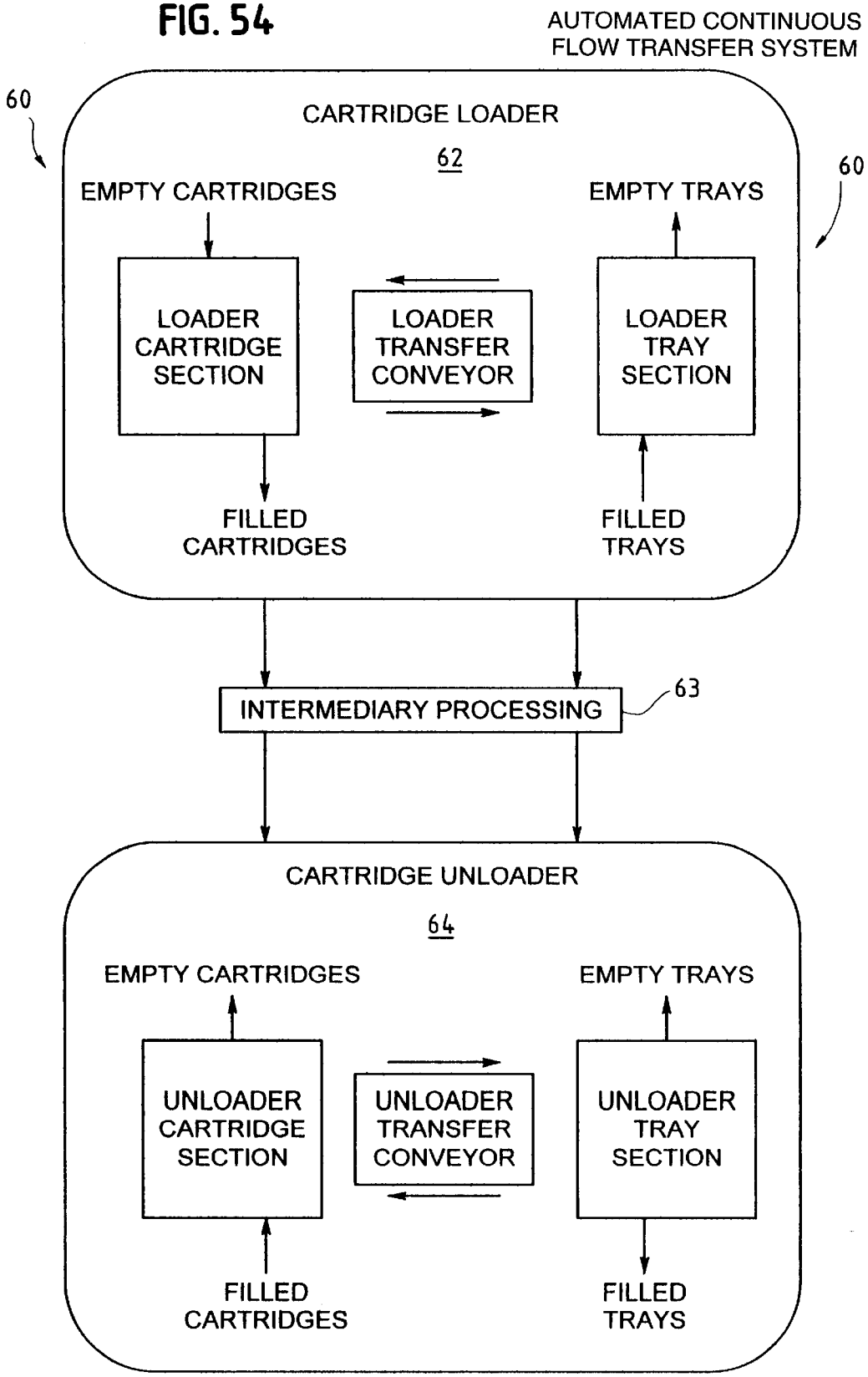
FIG. 54 is a flow diagram of the operation of the automated continuous flow transfer system of the present invention.

As seen in FIGS. 1–4 and 54, the present invention relates to an automated continuous flow transfer system 60 comprising a cartridge loader 62, cartridge unloader 64 and an intermediary processing operation 63. Referring to FIGS. 1 and 3, the automated continuous flow transfer system 60 provides for the uninterrupted transfer of mail pieces 66 initially contained in plastic or cardboard mail trays 68 into sturdy cartridges 70 of uniform size and weight, and then from the cartridges 70 back into the plastic or cardboard mail trays 68 once the mail pieces 66 in the cartridges 70 have been processed. A flow diagram of this automated continuous flow transfer system 60 is illustrated in FIG. 54.

Figure 4:
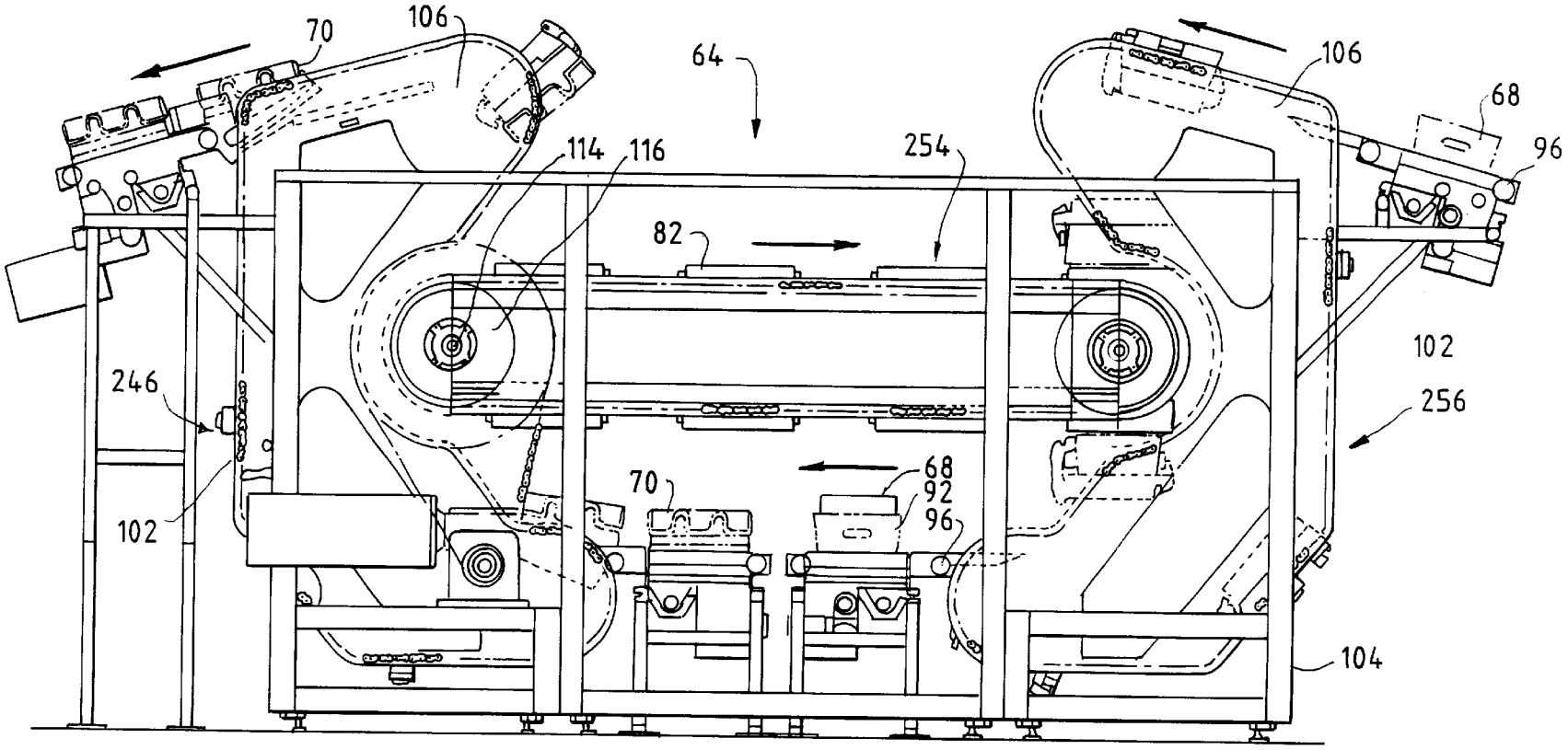
FIG. 4 is a side view of another embodiment of the cartridge unloader of the present invention utilizing a powered chain conveyor system.

As seen in FIGS. 1–4, the cartridge loader 62 and cartridge unloader 64 may be comprised of either (1) an interfacing powered flat belt conveyor system 72, as illustrated in FIGS. 1 and 3, (2) a powered chain conveyor system 74, as illustrated in FIGS. 2 and 4, or (3) other like conveyor systems designed to transfer mail trays 68 and cartridges 70 in a 360 degree (360°) rotation.

The cartridge loader 62 of the present invention provides for the transfer of the mail pieces 66 contained in the mail trays 68 into sturdy cartridges 70 of a standard size and weight specially designed to interface with an intermediary processing operation 63 (FIG. 54). Once deposited in the cartridges 70 by the cartridge loader 62, the mail pieces 66 are then delivered to the intermediary processing operation 63. After processing, the mail pieces 66 are then transferred back into the mail trays 68 by the cartridge unloader 64 for transport of the processed mail 66 to its next destination and ultimate delivery to the addressee.

Figure 5:
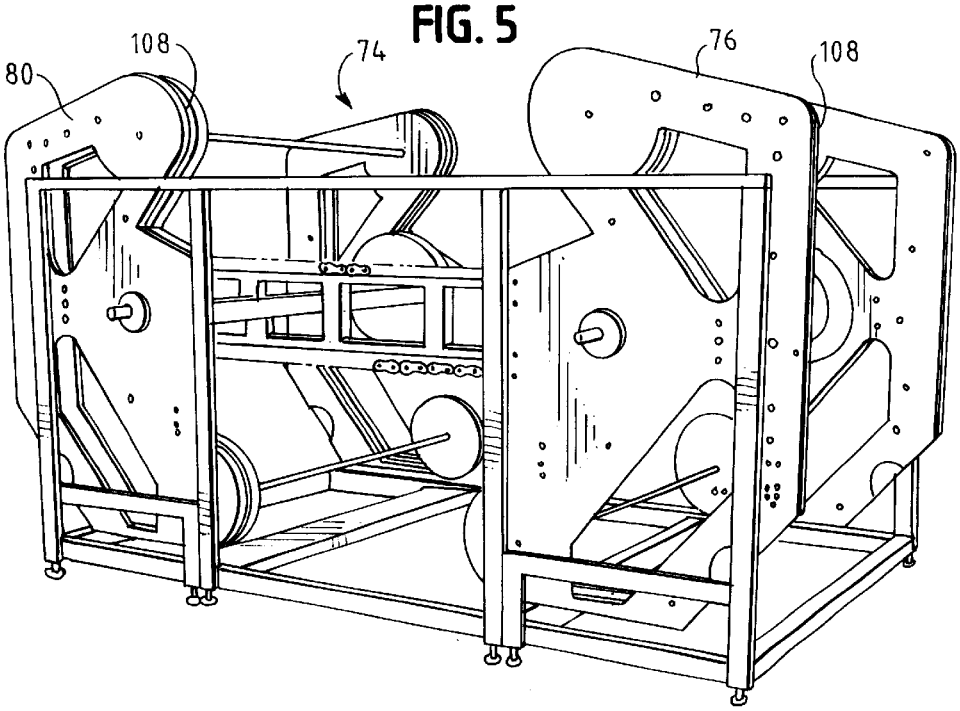
FIG. 5 is a perspective view of the framework or support structure of the cartridge loader and unloader of the present invention utilizing a powered chain conveyor system.

In operation, the cartridge loader 62, with the few exceptions, operates similar to the cartridge unloader 64, except that the cartridge unloader 64 operates in the opposite direction of the cartridge loader 62. Therefore, the same underlying conveyor structure can be utilized for both the cartridge loader 62 and cartridge unloader 64. For example, the powered chain conveyor system 74 depicted in FIGS. 5, 6 and 7 could be used as either a cartridge loader 62 or a cartridge unloader 64, depending upon the direction of movement of the conveyor system 74. Thus, for those figures intended to specifically depict a cartridge loader 62 or a cartridge unloader 64, directional arrows have been provided on the drawings to aid in the understanding of the present invention and to aid in the recognition of the specific conveyor systems.

Two embodiments of the cartridge loader 62 of the present invention are illustrated in FIGS. 1 and 2. FIG. 1 illustrates the powered flat belt conveyor design 72 and FIG. 2 illustrates the powered chain conveyor design 74. Two embodiments of the cartridge unloader 64 of the present invention are illustrated in FIGS. 3 and 4. FIG. 3 illustrates the powered flat belt conveyor design 72 and FIG. 4 illustrates the powered chain conveyor design 74. A detailed description of both the cartridge loader 62 and cartridge unloader 64, including all component parts, is found below.

A. Cartridge Loader 62

As seen in FIGS. 1 and 2, the cartridge loader 62 comprises of a loader tray section 76, a loader transfer conveyor 78, and a loader cartridge section 80. As further seen in FIGS. 1 and 2, the loader tray section 76, loader transfer conveyor 78 and loader cartridge section 80 are all interfaced with one another to provide for the uninterrupted transport of mail pieces 66 from the mail trays 68 into cartridges 70.

As illustrated in FIGS. 1 and 2, the loader tray section 76 receives full mail trays 68 from a tray management system (TMS), transports the mail trays 68 in synchronization with the loader transfer conveyor 78 to unload the mail 66 from the trays 68 into intermediate containers 82 located on the loader transfer conveyor 78 and then transfers the empty trays 68 back to the TMS.

The loader transfer conveyor 78 is located in the central portion of the cartridge loader 62 illustrated in FIGS. 1 and 2, and is comprised of evenly spaced intermediate containers 82 that accept the mail 66 from the filled mail trays 68 on the loader tray section 76. The loader transfer conveyor 78 then transports the mail pieces 66 in the intermediate containers 82 to the point where the loader transfer conveyor 78 interfaces with the loader cartridge section 80. At that point, the mail pieces 66 are then transferred from the intermediate containers 82 into empty cartridges 70 located on the loader cartridge section 80.

The loader cartridge section 80 is located in the left of FIGS. 1 and 2 and functions to receive empty cartridges 70 from the TMS, transport the cartridges 70 in synchronization with the intermediate containers 82 on the loader transfer conveyor 78 while mail 66 is loaded from the intermediate containers 82 of the loader transfer conveyor 78 into the cartridges 70, and then transfer the loaded cartridges 70 to the intermediary processing operation 63 (FIG. 54).

Although FIGS. 1 and 2 show the loader cartridge section 80 designed to interface two empty cartridges 70 at one time with a single intermediate container 82 on the loader transfer conveyor 78, the loader cartridge section 80, when required, can interface only one cartridge 70 at a time with an intermediate container 82 on the loader transfer conveyor 78. The loader cartridge section 80, therefore, is designed to communicate with the loader transfer conveyor 78 and feed either one cartridge 70 or two cartridges 70 at any one time toward the loader transfer conveyor 78 as necessary to accommodate the amount of mail 66 contained in the interfacing intermediate container 82.

To better understand the functionality of the cartridge loader 62 of the present invention, a detailed summary of each section of the cartridge loader 62 follows. The basic principles of construction and operation of the cartridge loader 62 of FIGS. 1 and 2 are substantially the same, unless otherwise noted.

1. Loader Tray Section 76

Figure 8:
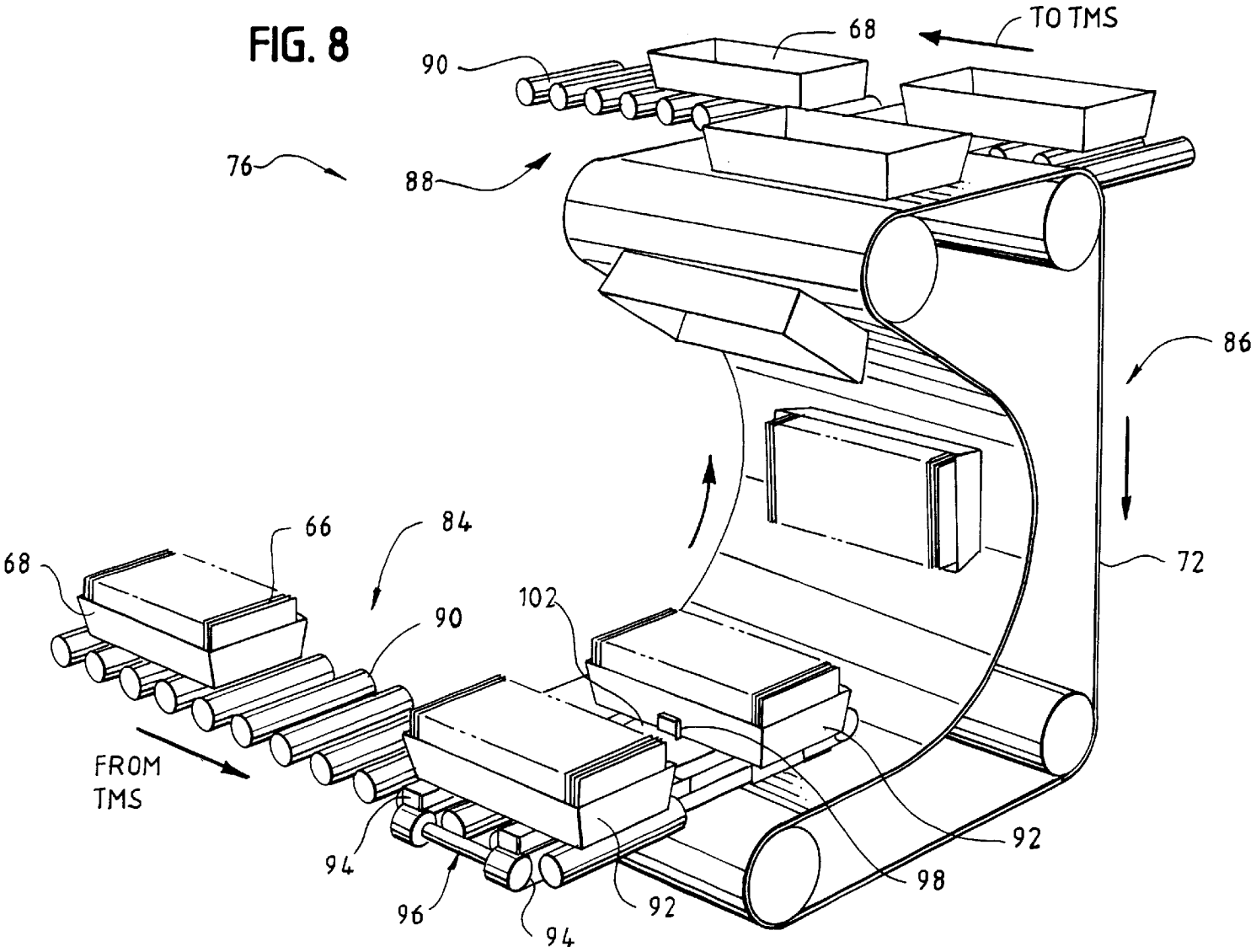
FIG. 8 is a front perspective view of the tray transport section of the cartridge loader illustrated in FIG. 1.

As shown in FIG. 8, the loader tray section 76 can be divided into three component parts: (1) a tray input conveyor 84, (2) a tray transport conveyor 86 and (3) a tray output conveyor 88. Although FIG. 8 illustrates the loader tray section 76 as it would appear on a powered flat belt conveyor design 72 of FIG. 1, the same three components are present in the powered chain conveyor design 74 of FIG. 2. As will be further described below, the only differences in the two conveyor designs 72 and 74 with regard to the loader tray section 76 is the manner in which the mechanism that secures the mail trays 68 to the conveyor system 72 or 74 is affixed to the loader tray section 76.

As best illustrated by FIGS. 1 and 8, the tray input conveyor 84 of the loader tray section 76 receives trays 68 loaded with mail 66 from the TMS and feeds the supply of trays 68 to the tray transport conveyor 86. The tray transport conveyor 86 accepts the loaded trays 68 from the tray input conveyor 84, releasably secures the trays 68 to the conveyor 72 (FIG. 1) or 74 (FIG. 2) and transfers the mail 66 in the mail trays 68 to the intermediate containers 82 located on the loader transfer conveyor 78, as will be described. Once the trays 68 are empty, the tray transport conveyor 86 then passes the empty trays 68 to the tray output conveyor 88, releases the empty trays 68 from conveyor 72 or 74, and the tray output conveyor 88, then transports the empty mail trays 68 back to the TMS. A detailed summary of each of the three component parts of loader tray section 76 follows.

a. Tray Input Conveyor 84

Loaded trays 68 are supplied to the tray input conveyor 84 from the TMS and are delivered to the tray transport conveyor 86 by a powered roller conveyor 90 having pusher fingers 94 that engage the loaded trays 68. The powered roller conveyor 90 interfaces with the TMS to receive loaded trays 68 and then, as illustrated in FIG. 8, transports trays 68 to the area adjacent to the tray transport conveyor 86. The powered roller conveyor 90 advances the trays 68 into the cartridge loader 62 such that the end 92 of the trays 68 is brought first into the cartridge loader 62. Furthermore, the trays 68 are advanced into the cartridge loader 62 so that the trays 68 are registered to align with the intermediate containers 82 of the loader transfer conveyor 78 when advanced toward the tray transport conveyor 86, as will be explained.

At the properly synchronized time, the tray input conveyor 84 actuates a pusher finger 94 on a finger belt conveyor 96 that advances a tray 68 toward the tray transport conveyor 86 in synchronization with a pusher paddle 98 located on the tray transport conveyor 86. As described in more detail below, the pusher paddle 98 of the tray transport conveyor 86 is part of an engaging mechanism 100 (FIG. 11) that engages and maintains each loaded mail tray 68 against the tray transport conveyor 86 until the mail tray 68 reaches the tray output conveyor 88, where it is then released from the tray transport conveyor 86 and returned to the TMS by the tray output conveyor 88.

b. Tray Transport Conveyor 86

Figure 9:
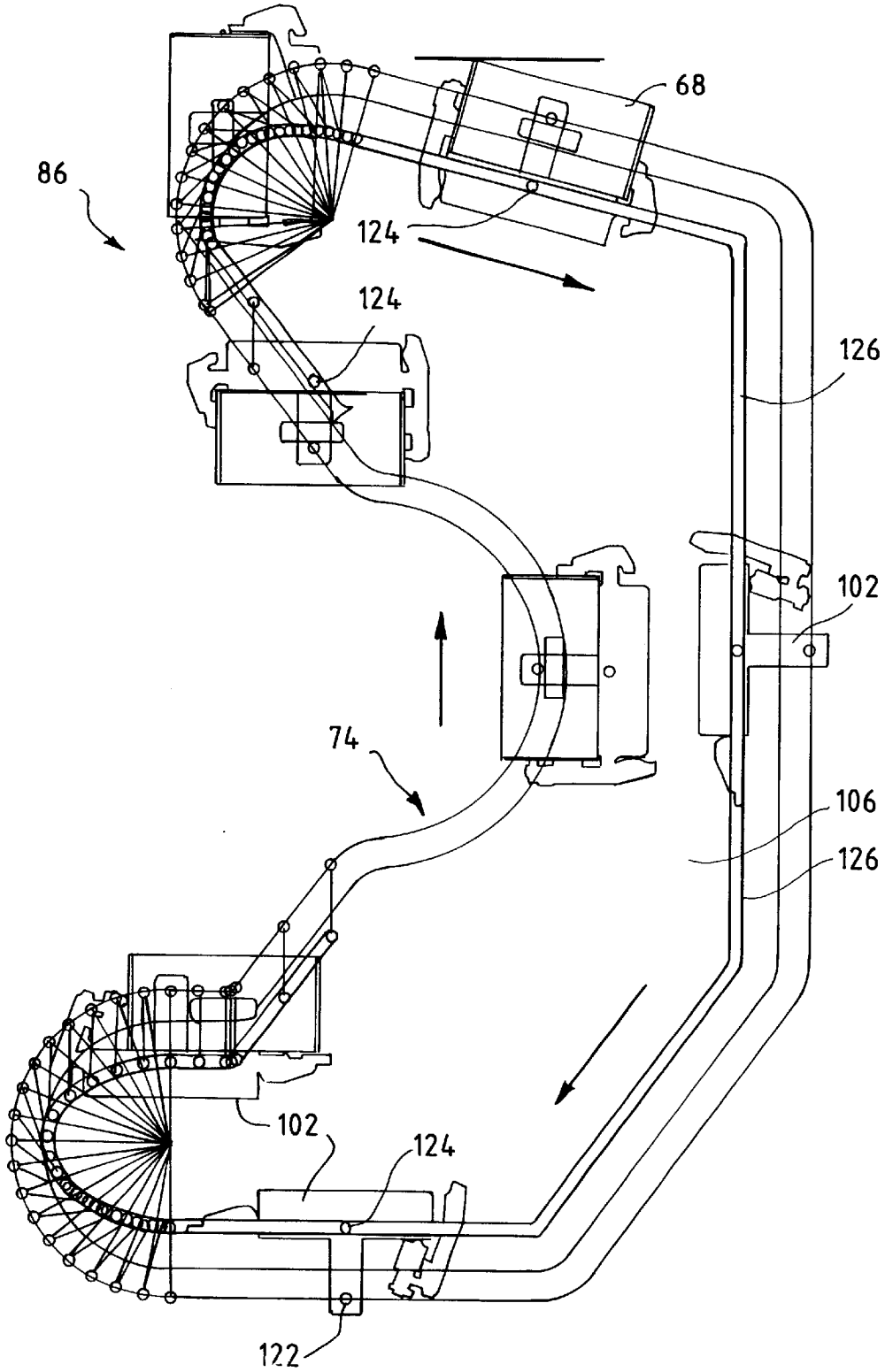
FIG. 9 is a side view of the tray transport section of the cartridge loader illustrated in FIG. 2.

As seen in FIGS. 8 and 9, the tray transport conveyor 86 generally comprises of a series of engaging carriages 102 located at fixed pitch points, in the illustrated embodiments. As further seen in FIGS. 2 and 9, in one embodiment of the present invention, the tray transport conveyor 86 is designed as a part of a powered chain conveyor system 74. In this embodiment, the tray transport conveyor 86 is comprised of a supporting structure 104 and two opposing frame members 106 mounted to the supporting structure 104 such that the frame members 106 are aligned with one another and elevated off the ground to allow the engaging carriages 102 to pass underneath the frame members 106. Although not shown in the attached figures, similar frame members with a supporting structure would be used in the embodiment utilizing a powered flat belt conveyor design.

Figure 6:
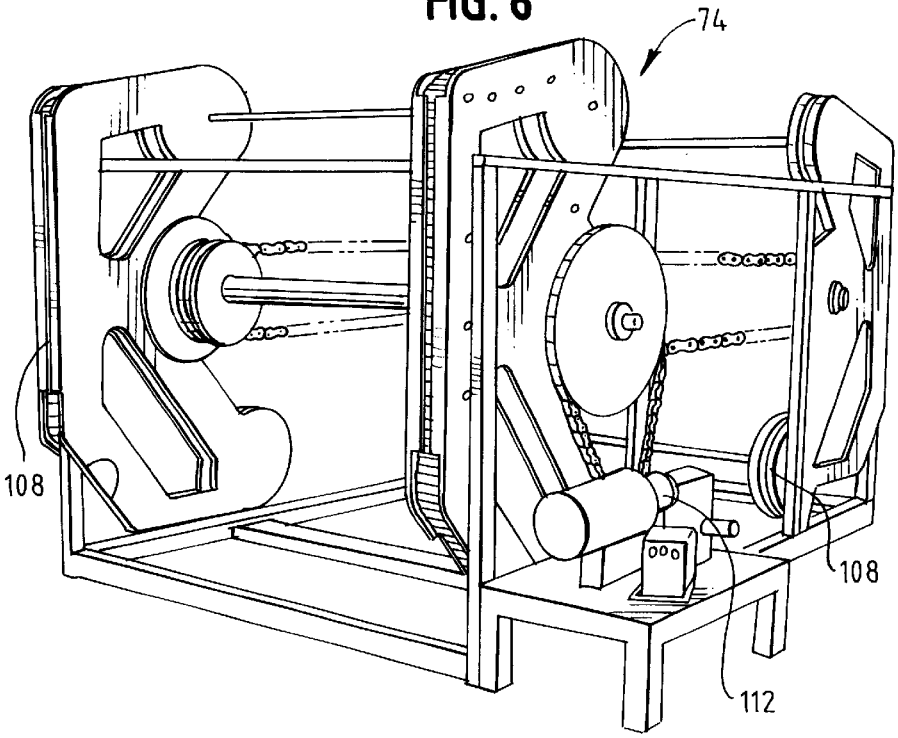
FIG. 6 is the opposing side view of the framework or support structure of the cartridge loader and unloader illustrated in FIG. 5.
Figure 7:
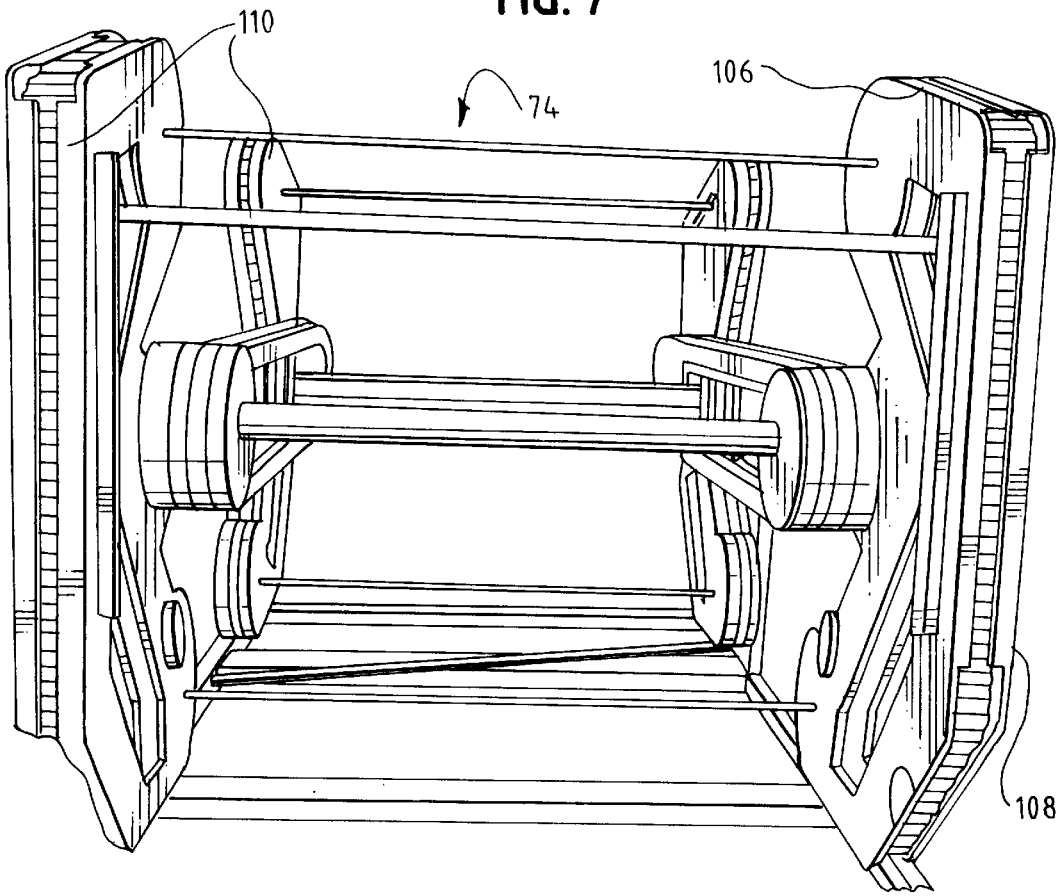
FIG. 7 is a side perspective view of the cartridge loader and unloader illustrated in FIG. 5.
Figure 10:
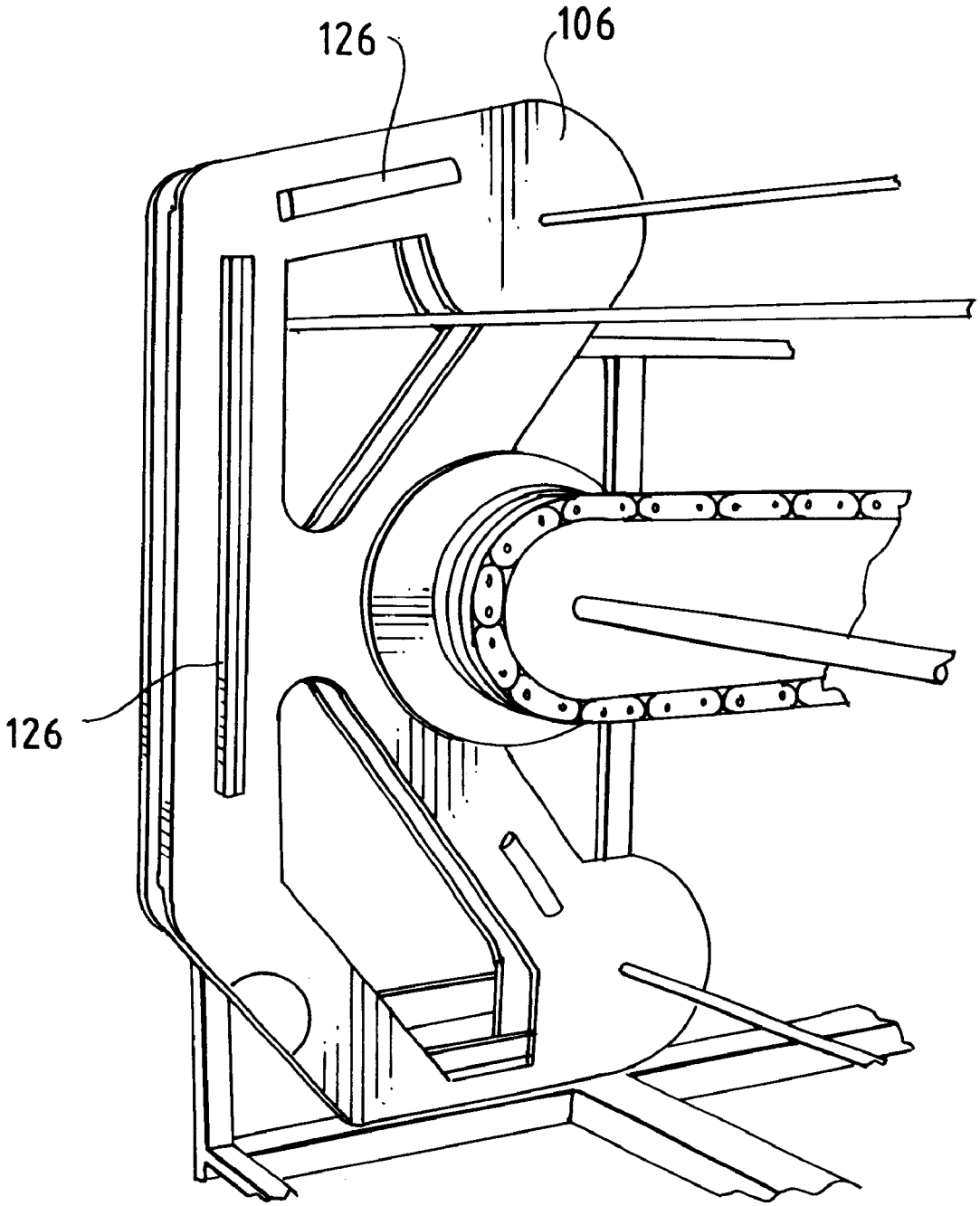
FIG. 10 is the side perspective view of a single frame of the cartridge or tray section of the cartridge loader and unloader illustrated in FIG. 5.

As seen in FIGS. 6, 7 and 10, each frame member 106 has a track 108 for housing a conveyor chain 110. Each conveyor chain 110 is driven by a motor 112 connected to a shaft 114 that drives toothed sprockets 116 mounted on the frame members 106. The toothed sprockets 116 then engage the conveyor chain 110 and, as the toothed sprockets 116 rotate, move the conveyor chain 110 through the track housing 108 on the frame members 106. Since the conveyor chains 110 on the tray transport conveyor 86 are aligned with one another, the same motor 112 and shaft 114 may be used to turn the toothed sprockets 116 mounted on each opposing frame member 106, as illustrated in FIG. 6.

Figure 17:
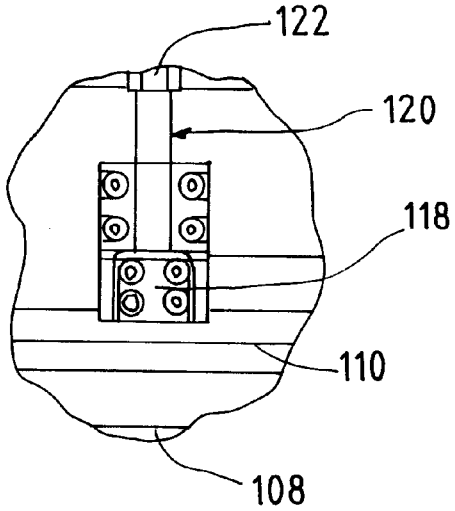
FIG. 17 is a plan detail view illustrating the mounting of the engaging carriage illustrated in FIG. 15 to a powered chain conveyor system.
Figure 18:
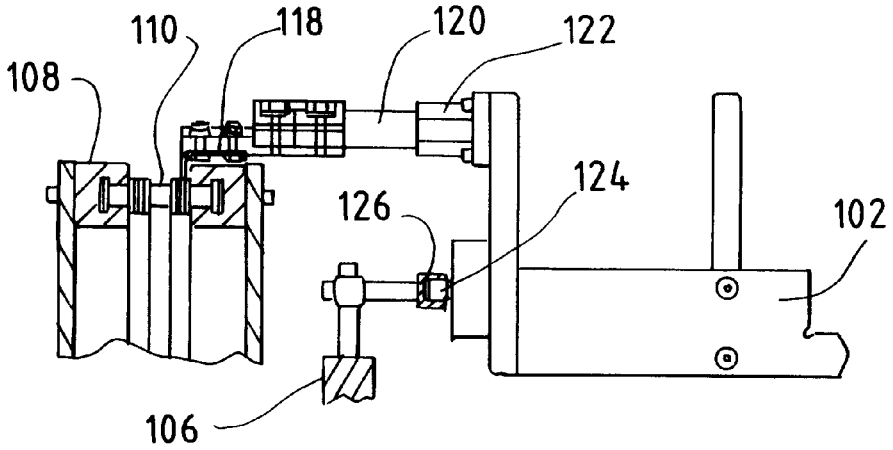
FIG. 18 is a side view illustrating the interfacing of the engaging carriages illustrated in FIG. 15 and a cam guide located on the frame sections of the present invention.
Figure 19:
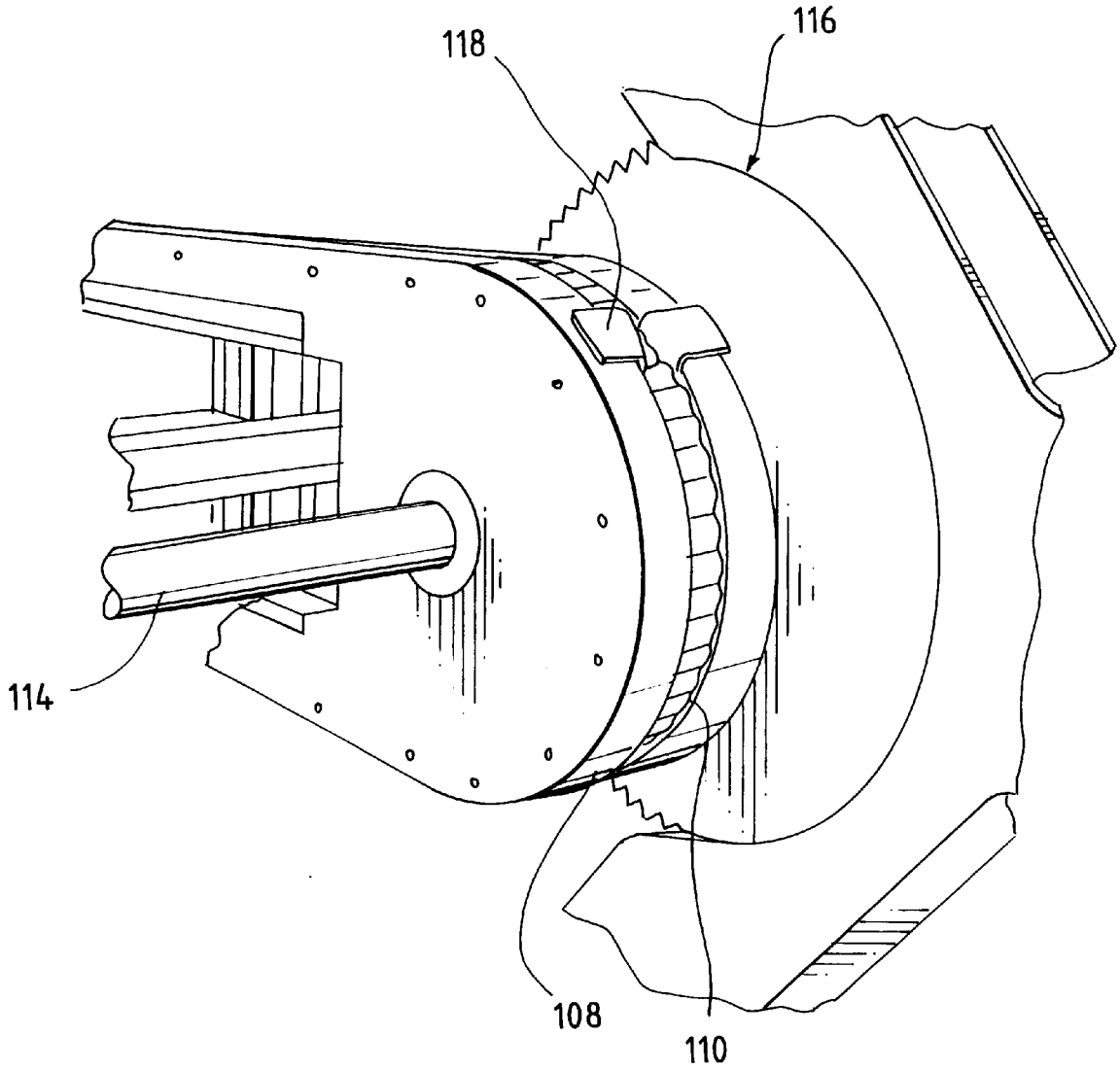
FIG. 19 is a perspective view of the chain track of the loader and unloader transfer conveyor of the cartridge loader and cartridge unloader illustrated in FIG. 5.

When used with a powered chain conveyor system as illustrated in FIG. 2, the engaging carriages 102 of the tray transport conveyor 86 are pivotally mounted at each end to the conveyor chains 110 such that the engaging carriages 102 span between and are held at their ends by the conveyor chain 110 moving through each frame member 106. To engage the ends of the engaging carriages 102, each conveyor chain 110 has L-shaped mounting brackets 118 integral to and extending from the conveyor chain 110 at fixed pitch points as illustrated by FIGS. 17, 18 and 19. These L-shaped mounting brackets 118 have one end of the bracket 118 integral to a chain link on the conveyor chain 110, while the other end of the mounting bracket 118 extends upward and away from the conveyor chain 110 to allow for the attachment of engaging carriages 102 to the opposing end of the mounting bracket 118.

While the ends of the engaging carriages 102 may be rigidly mounted to the mounting brackets 118, the engaging carriages 102 of the present invention, when used in connection with the powered chain conveyor system 74, are pivotally connected to the conveyor chain 110. As seen in FIGS. 9, 17 and 18, this pivotal connection is accomplished by mounting shafts 120 to the lateral exposed ends of the mounting brackets 118 and then interfacing the shafts 120 with arm gussets 122 located at each end of the engaging carriages 102 (FIG. 18).

By pivotally connecting the engaging carriages 102 to the conveyor chains 110 of the tray transport conveyor 86, a more condensed and modular cartridge loader 62 can be designed. Because the engaging carriages are pivotally connected to the conveyor chains 110, the force of gravity will cause the engaging carriages 102, especially when gripping a mail tray 68, to be completely inverted and face downward when traveling along the tray transport conveyor 86. Thus, the tray transport conveyor 86 does not need as steep an angle of incline or decline on the frame tracks 108 to invert the trays 68. The trays 68 are inverted naturally by the effect of gravity. However, because of this natural tendency to hang in the inverted position, a separate mechanism must be utilized to maintain the engaging carriages 102 in a position not otherwise dictated by gravity.

Referring to FIG. 18, to maintain the engaging carriages 102 in a desired position not dictated by gravity, the engaging carriages 102 are designed to interface with the frame member 106 through cam follower 124 and a cam guide 126. In this embodiment, the engaging carriages 102 of the tray transport conveyor 86 are designed to include cam followers 124 located at each end of the engaging carriages 102. Each frame member 106 is then designed to have a corresponding cam guide 126 located on the frame member 106 that engages the cam follower 124 on the engaging carriages 102 when it is desirable to maintain the carriages 102 in a given position. For example, it is desirable to have the carriages 102 in an upright and parallel position with the movement of the conveyor chains 110 when the engaging carriages 102 are advanced to engage a mail tray 68 as shown at the bottom left portion of FIG. 9.

Figure 11:
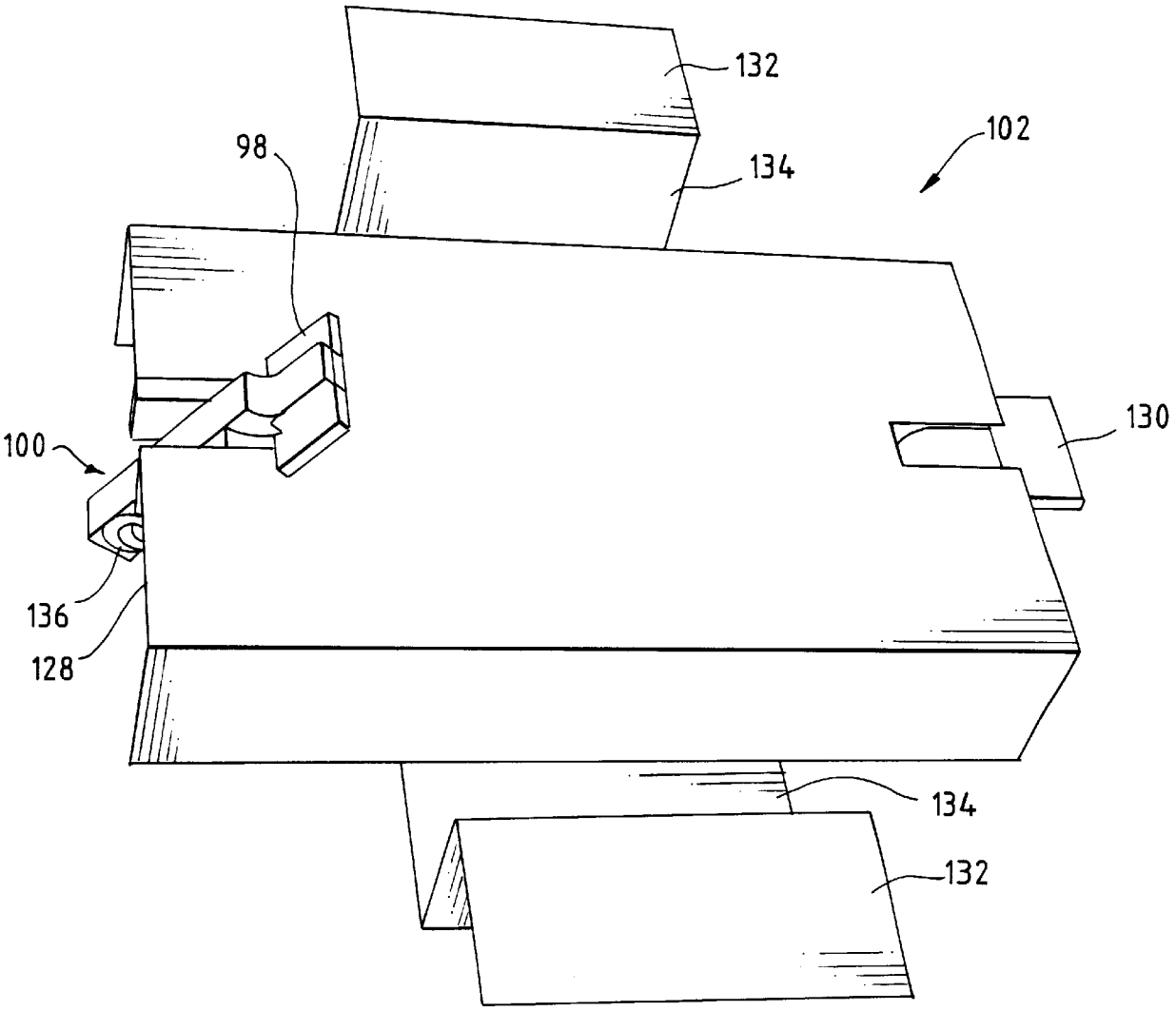
FIG. 11 is a plan perspective view of an engaging carriage of the present invention designed for use with a cartridge loader or cartridge unloader having only one engaging mechanism.
Figure 12:
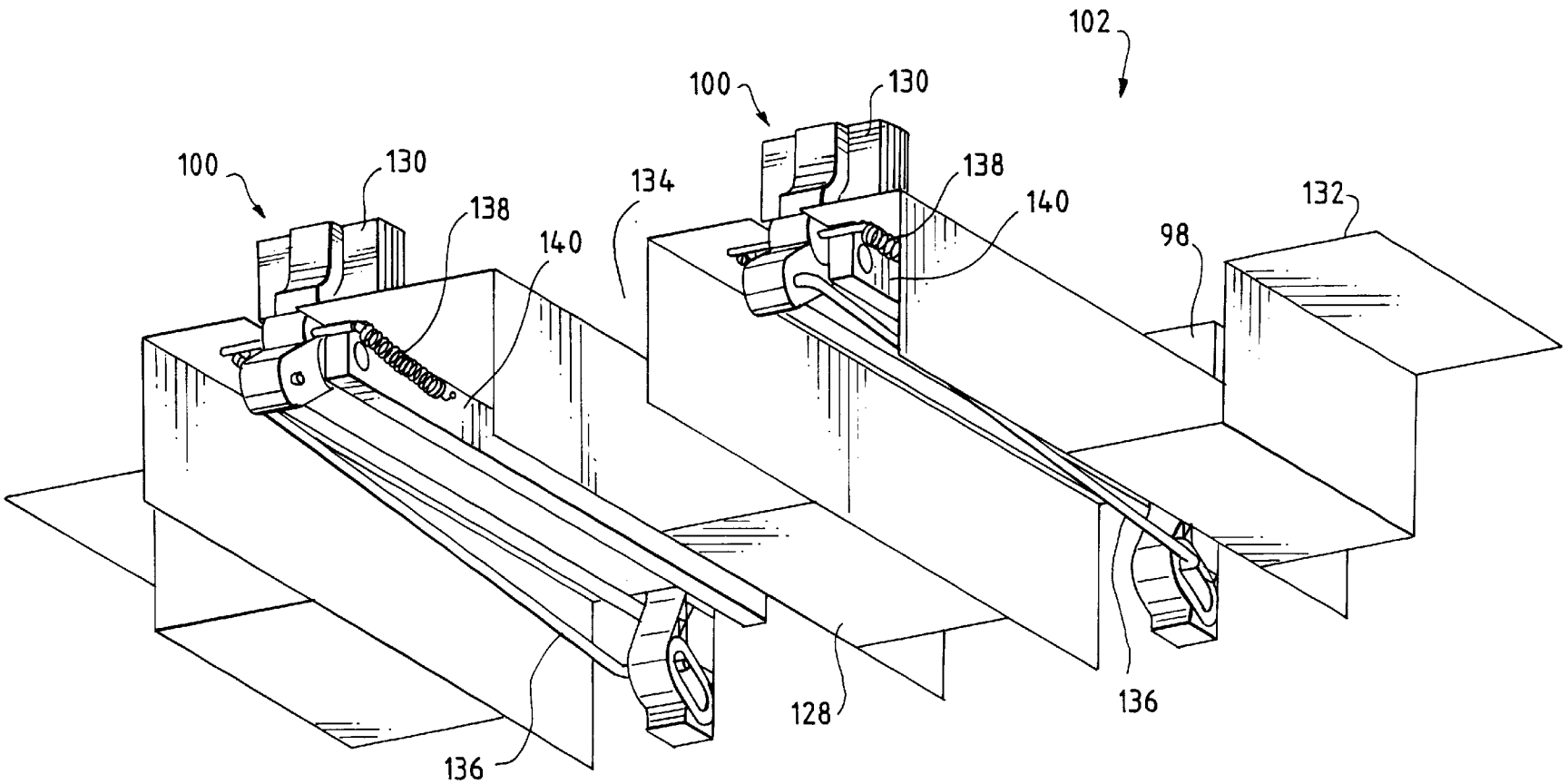
FIG. 12 is a bottom perspective view of the engaging carriage having two engaging mechanisms.
Figure 15:
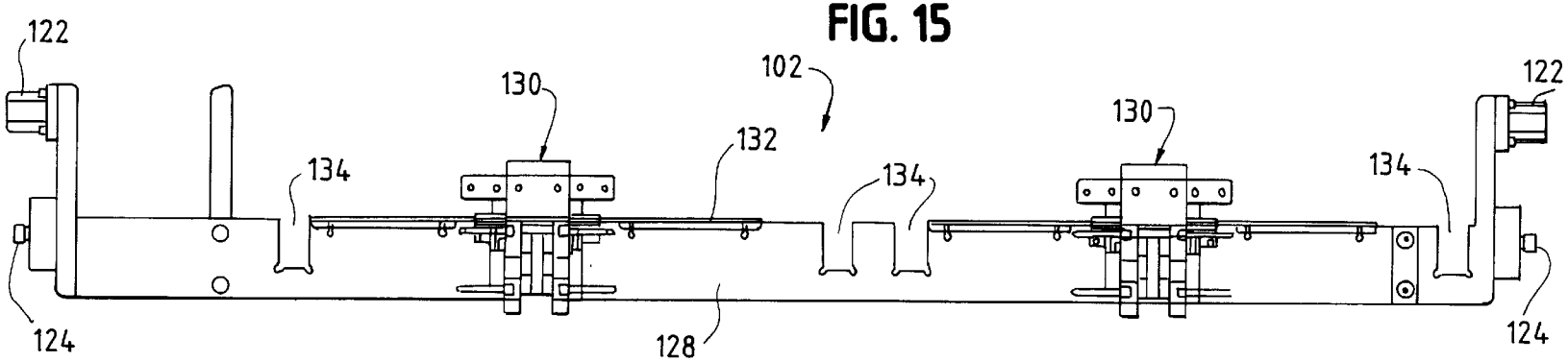
FIG. 15 is a side view of an engaging carriage of the present invention designed for use with a cartridge loader utilizing the powered chain conveyor system illustrated in FIGS. 2 and 4.
Figure 16:
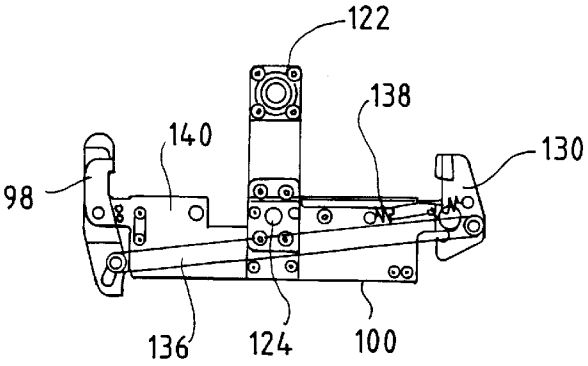
FIG. 16 is a front view of the engaging carriage illustrated in FIG. 15.

Rather than mounting the ends of the engaging carriages 102 directly to a conveyor chain 110, the tray transport conveyor 86 can be designed, as seen in FIG. 8, to include a powered flat belt conveyor 72 having the engaging carriages 102 located at fixed pitch points along the belt. In this embodiment, the engaging carriages 102 would not pivot, but be rigidly affixed to the belt. In general, the design of the engaging carriages 102 are the same whether affixed to a belt conveyor or whether mounted directly to a conveyor chain 110. As discussed above, the main difference between the engaging carriages 102 is the manner in which the carriages 102 are mounted to the conveyor system 72 or 74, which, as illustrated by the drawings, may also slightly effect the body design of the carriages 102. FIGS. 11 and 12 illustrate an engaging carriage 102 designed for use in connection with a powered flat belt conveyor system 72. FIGS. 15 and 16 illustrate an engaging carriage 102 designed for use in connection with a powered chain conveyor system 74.

Although the body design of the engaging carriages 102 may vary slightly, the function and operation of the engaging carriages 102 in the present invention remains the same. Described below is a detailed description of the engaging carriages 102 as used in connection with either conveyor system 72 or 74.

The engaging carriages 102 on the tray transport conveyor 86 are used to secure and transport the trays 68 from the tray input conveyor 84 to the tray output conveyor 88, and to transfer the mail pieces 66 to intermediate container 82 (FIGS. 1 and 2). As seen in FIGS. 11 through 16, each engaging carriage 102 is comprised of an undercarriage base 128 that houses an engaging mechanism 100. The engaging mechanism 100 is comprised of at least one pusher paddle 98 and at least one gripper paddle 130 that combine to secure each tray 68 against the engaging carriage 102. As will become more apparent later in the disclosure, the engaging mechanism 100 of the tray transport conveyor 86 are utilized throughout the present invention in most all instances where a conveyor system 72 or 74 is required to engage and maintain a mail tray 68 or cartridge 70 for a set distance and at an inverted position for at least a portion of such distance.

As illustrated by FIGS. 11 and 12, each engaging carriage 102 can include one or more engaging mechanisms 100. It is preferred that two engaging mechanisms 100 are used with each carriage 102, as seen in FIGS. 12 and 15, so that each engaging carriage 102 can readily accommodate both large and small sized mail trays 68. FIG. 11 illustrates an engaging carriage 102 having only one engaging mechanism 100, while FIGS. 12 and 15 illustrate an engaging carriage 102 having two engaging mechanisms 100.

The undercarriage base 128 is designed to have a raised tray support platform 132 that serves to support the trays 68 coming off the tray input conveyor 84. As seen in FIGS. 11 through 15, the tray support platform 132 is lowered on each side of the engaging mechanism 100 to provide clearance areas 134 for the passage of the finger belt conveyors 96 that advance the trays 68 from the powered rolled conveyor 90 toward the tray transport conveyor 86.

Figure 13:
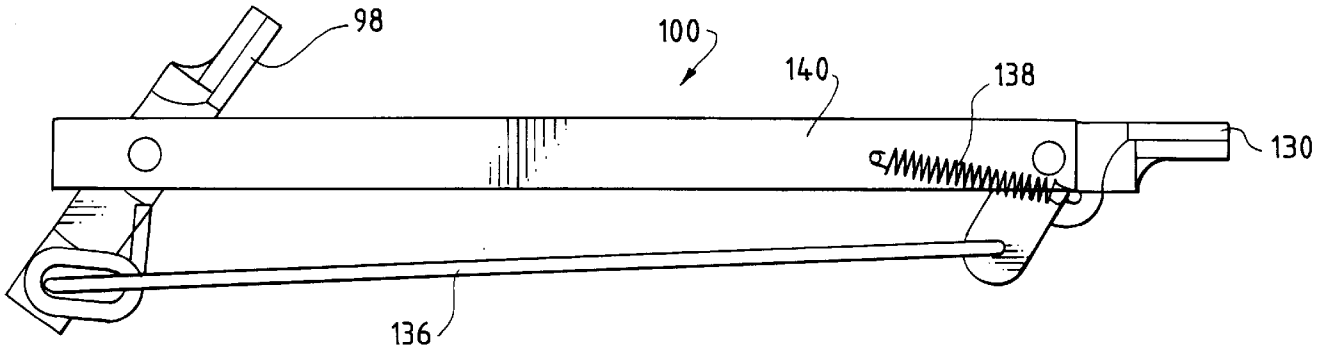
FIG. 13 is a front view of the engaging mechanism of the engaging carriage illustrated in FIGS. 11 and 12 shown in its disengaged position.
Figure 14:
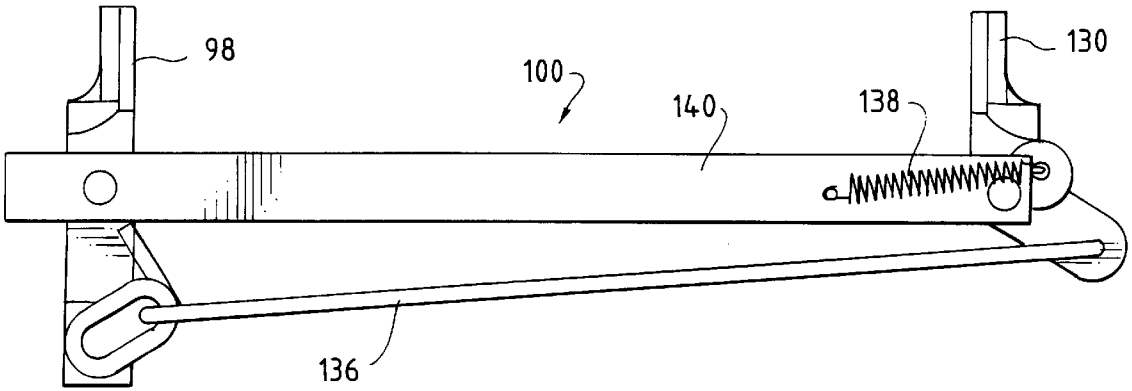
FIG. 14 is a front view of the engaging mechanism of the engaging carriage illustrated in FIGS. 11 and 12 shown in its engaged position.

As seen in FIGS. 13 and 14, each engaging mechanism 100 is comprised of a pivotal pusher paddle 98, a pivotal gripper paddle 130, a paddle linkage rod 136, a pair of springs 138 and a connecting bar 140. FIG. 13 represents the engaging mechanism 100 in its relaxed state, wherein, the pusher paddle 98 is inclined slightly forward and the gripper paddle 130 is in a parallel plane with the connecting bar 140. The paddles 98 and 130 which pivot about center at each end of the connecting bar 140 and are connected to one another by the paddle linkage rod 136. A pair of springs 138 also extends between the gripper paddle 130 and the connecting bar 140 to add tension to the gripper paddle 130 when engaged to maintain a tray 68.

Each engaging mechanism 100 will remain in its relaxed state until coming into contact with a mail tray 68. When engaged with a mail tray 68, the engaging mechanism 100 will appear as illustrated in FIG. 14. Under the influence of the leading side edge of the advancing mail tray 68, the pusher paddle 98 will be forced into its upright position by its contact with the side of tray 68, the paddle linkage rod 136 will move to the right as shown in FIG. 13 by the arrow, and will push the gripper paddle 130 and rotate the gripper paddle 130 upward ninety degrees (90°), to engage the opposing or trailing side of the advancing mail tray 68. The springs 138 are then extended to an over-center position when the gripper paddle 130 is positioned upward, creating tension on the gripper paddle 130 and causing a film grasp of the tray 68 between the pusher paddle 98 and gripper paddle 130.

In operation, the movement of the trays 68 from the tray input conveyor 84 by the finger belt conveyor 96 (FIG. 8) is synchronized with the movement of the engaging carriages 102 on the tray transport conveyor 86 such that the trailing edge of a tray 68 arrives at the transfer point between tray transport conveyor 86 and finger belt conveyor 96 just before the pusher paddle 98 of an engaging carriage 102. The pusher paddle 98 then makes contact with the side of the tray 68. When the pusher paddle 98 comes in contact with the mail tray 68, the weight of the tray 68 moves the pusher paddle 98 rearward and into its upright position, as shown in FIG. 14. As the tray 68 is moved against the pusher paddle 98, the spring loaded gripper paddle 130 rotates upward ninety degrees (90°) to grip the tray 68 firmly between the pusher paddle 98 and the gripper paddle 130. The advancing engaging carriages 102 continue to firmly engage each mail tray 68 until the mail tray 68 reaches the tray output conveyor 88 (FIG. 8) at which point it is released and fed to the tray output conveyor 88 for subsequent transfer to the TMS.

As seen in FIG. 1, the transfer of the mail 66 from the mail trays 68 to the intermediate containers 82 is accomplished by not only aligning the engaging carriages 102 with the intermediate containers 82 but also matching the horizontal component of the velocities of the tray transport conveyor 86 and the loader transfer conveyor 88. When an intermediate container 82 initially overlaps an engaging carriage 102, supporting a mail tray 68, the intermediate container 82 is inverted and the mail tray 68 is positioned upright. At this point, the intermediate container 82 has enveloped the top of the mail tray 68. As the conveyors 86 and 78 advance at the same horizontal velocity, the mail tray 68 and intermediate container 82 are synchronously transported through a one-hundred eighty degree (180°) directional change through the vertical axis. This change of direction renders the mail tray 68 inverted and the intermediate container 82 in its upright position. During this directional change, all the mail 66 in the mail tray 68 is transferred by gravity to the intermediate container 82. After the transfer of the mail 66 into the intermediate container 82, the now empty trays 68 are conveyed by the tray transport conveyor 86 to the tray output conveyor 88 (FIG. 8).

c. Tray Output Conveyor 88

As seen in FIG. 8, the tray output conveyor 88, like the tray input conveyor 84, consists of a powered roller conveyor 90 that receives the empty trays 68 from the tray transport conveyor 86. Before transfer to the tray output conveyor 88, the gripper paddle 130 of the engaging mechanism 100 on the tray transport conveyor 86 is released and pivoted downward so that transfer of the tray 68 to the tray output conveyor 88 can be accomplished. A pusher finger 94 on finger belt conveyor 96 may be used to move the empty trays 68 off of the tray transport conveyor 86 and onto the tray output conveyor 88, similar to the manner in which the loaded trays 68 were transferred from the tray input conveyor 84 to the tray transport conveyor 86. Once received by the tray output conveyor 88, the empty trays 68 are then conveyed to the TMS to receive additional mail and repeat the cycle of operation.

2. Loader Transfer Conveyor 78

Figure 20:
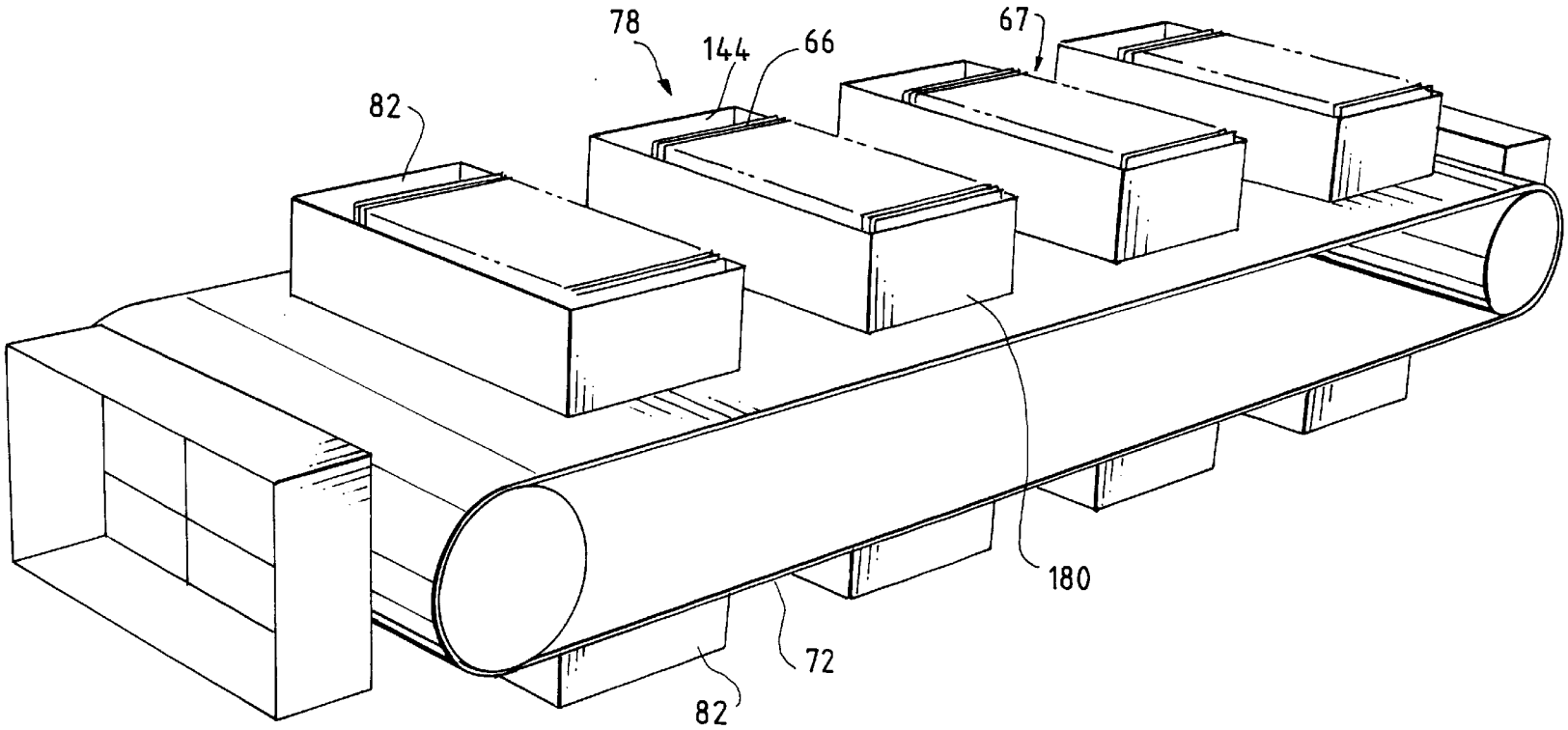
FIG. 20 is a front perspective view of the loader and unloader transfer conveyor of the present invention utilizing a powered flat belt conveyors system and having non-divisible intermediate containers.
Figure 21:
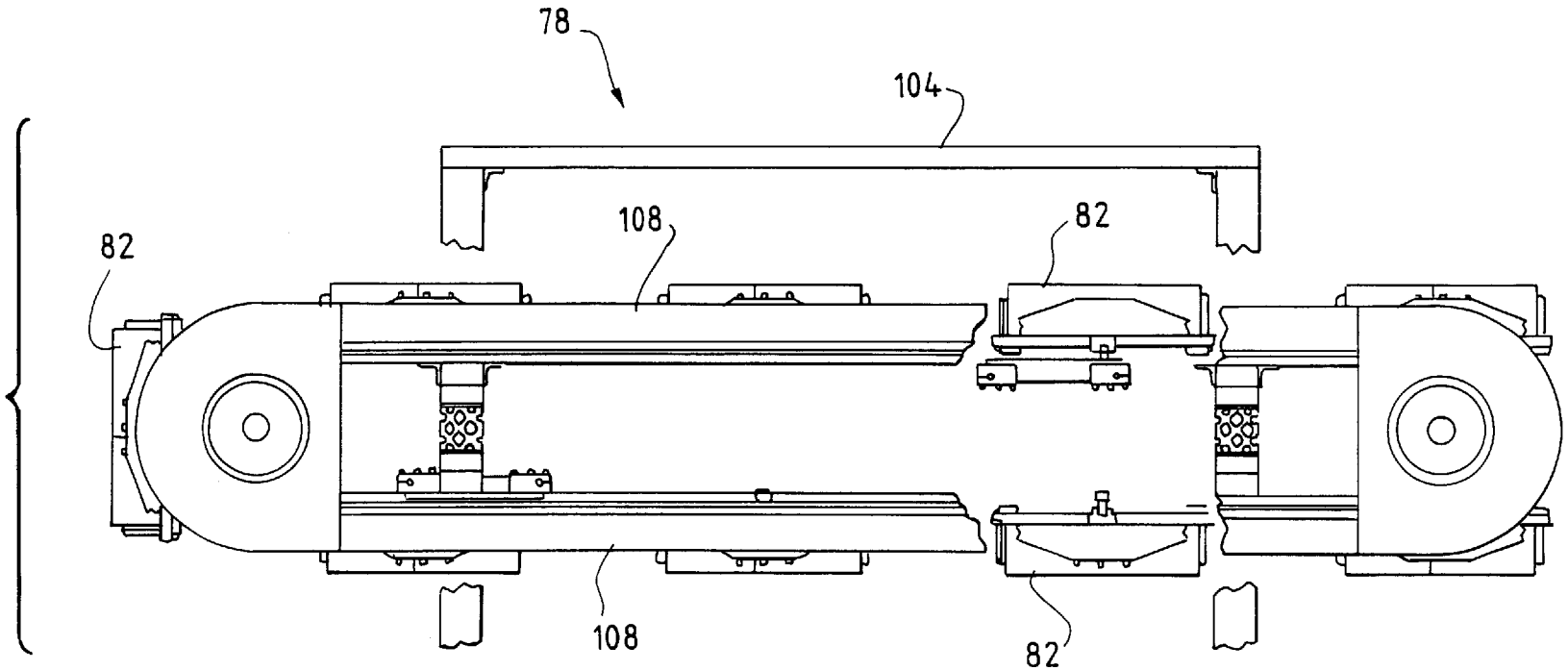
FIG. 21 is a front view of the loader transfer conveyor of the present invention utilizing a powered chain conveyor system.
Figure 22:
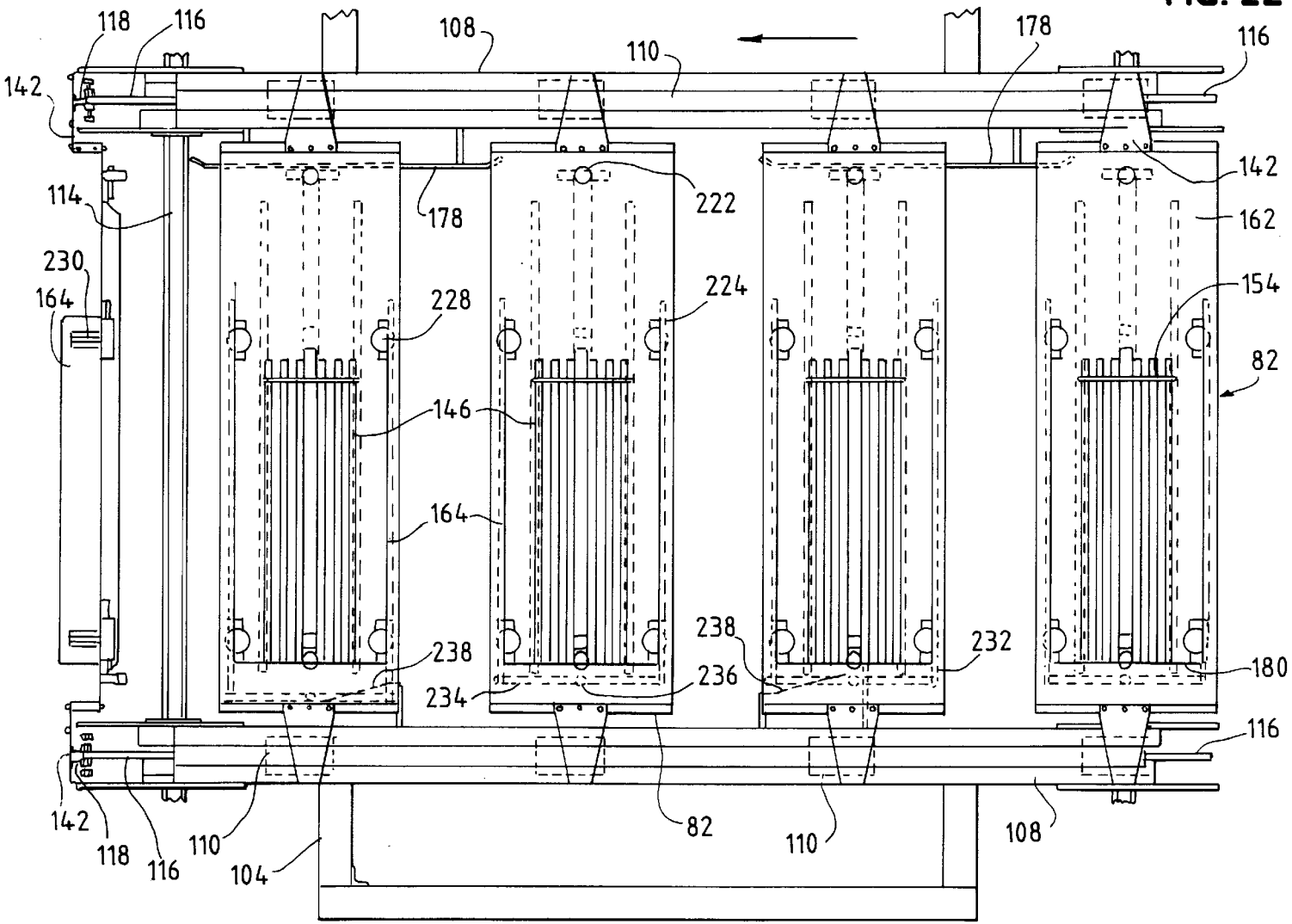
FIG. 22 is a plan view of the unloader transfer conveyor illustrated in FIG. 21.

As illustrated by FIGS. 1 and 2, the loader transfer conveyor 78 of the present invention provides for the intermediary handling of the mail pieces 66 being transferred into either one or two mail cartridges 70. As seen in FIGS. 20, 21 and 22, the loader transfer conveyor 78, like the tray transport conveyor 86, generally consists of a series of intermediate containers 82 affixed to the conveyor system 72 or 74 at fixed pitch points. FIGS. 1 and 20 illustrate the loader transfer conveyor 78 designed for use with a powered flat belt conveyor system 72. FIGS. 2, 21 and 22 illustrate the loader transfer conveyor 78 as it would appear as part of a powered chain conveyor system 74.

In operation, the loader transfer conveyor 78 accepts mail pieces 66 from the trays attached to the transport conveyor 86 as the intermediate containers 82 envelop the mail trays 68. As discussed earlier, this is accomplished by overlapping the tray transport conveyor 86 and loader transfer conveyor 78 with matched horizontal velocities. In the initial overlap, the mail tray 68 is oriented right side up with an inverted intermediate container 82 positioned over its top. The enveloping mail conveyors 86 and 78 are synchronously transported through 180° of directional change through the vertical axis. This change of direction renders each mail tray 68 inverted and the intermediate container 82 upright. During the directional change of the mail conveyors 86 and 78, the mail tray 68 is inverted and the mail 66 is transferred by gravity to the intermediate container 82.

Figure 31:
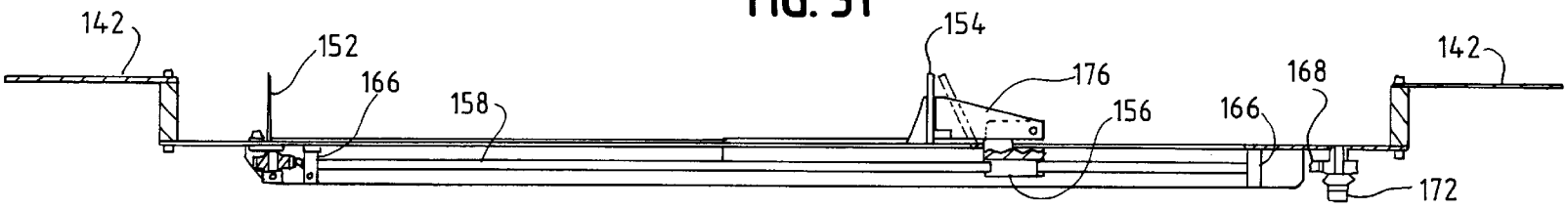
FIG. 31 is a side elevation view of the intermediate container illustrating the compressing system of the present invention.
Figure 32:
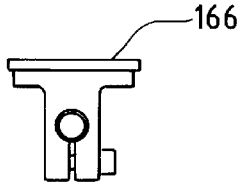
FIG. 32 is a front view of a shaft hanger of the mail compressing system of the present invention.

Once the mail has been transferred to the intermediate container 82, it is then drawn into a uniform and limited compression mail stack 67. This is achieved by implementing a mail compressing system 148 as illustrated in FIG. 31 into the intermediate container 82. The mail compressing system 148 will then gather the mail 66 in a controlled manner into a consolidated mail stack 67. Compression of the mail stack 67 is controlled to a fixed value by use of a limiting device regulating the maximum force which can be reacted through the mail stack 67 and front wall 180 (FIG. 23, of the intermediate container 82.

After drawing the mail into the consolidated mail stack 67, the mail stack 67 is measured to determine whether its size exceeds the capacity of a single cartridge 70. If the mail stack 67 is measured to exceed the capacity of a cartridge 70, it is engaged by a mail dividing system 150 (FIG. 23) that separates the stack into two mail stacks 67 contained within the intermediate container 82 and provides face support to the split mail stacks 67.

Transfer of mail from the loader transfer conveyor 78 to one or two cartridges 70 occurs as a cartridge or cartridges 70 envelop the intermediate container 82. Again, this is accomplished by overlapping the loader transfer conveyor 78 and the loader cartridge section 80 with matched horizontal velocities. In the initial overlap, an intermediate container 82 is oriented right side up with an inverted cartridge 70 over the top of the intermediate container 82. Again, the enveloping mail conveyors 78 and 80 are synchronously transported through 180° of directional change through the vertical axis. The change of direction renders the intermediate container 82 inverted and the cartridge 70 upright. During this directional change, the intermediate container 82 is inverted and mail 66 is transferred by gravity to the cartridge 70 in the same orientation as it was originally delivered to the cartridge loader 62.

Figure 30:
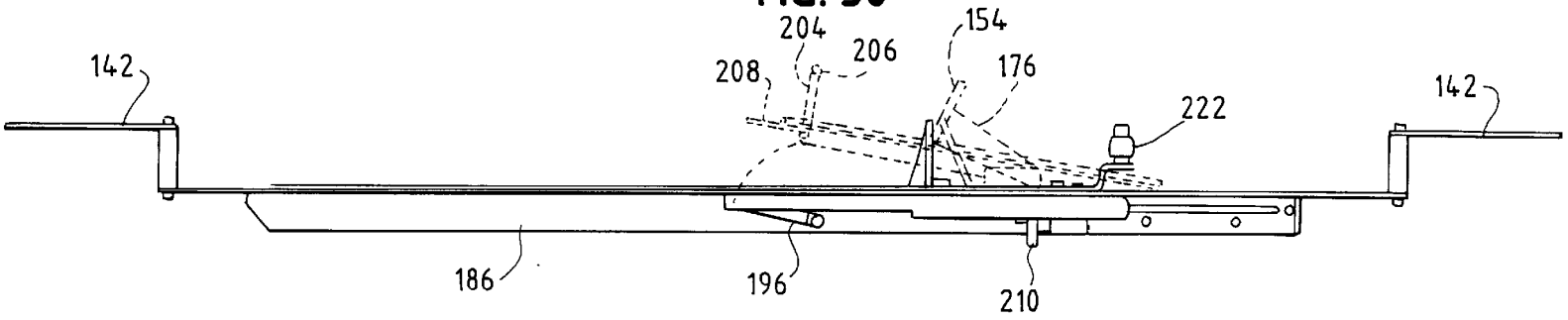
FIG. 30 is a sectional view of the intermediate container illustrated in FIG. 23 shown while in process of actuating taken along line 30—30.

As seen in FIGS. 21 and 22, the loader transfer conveyor 78 utilizing the powered chain conveyor system 74 has two parallel side tracks 108 for housing opposing conveyor chains 110. The conveyor chains 110 have mounting brackets 118 for the attachment of the intermediate containers 82 to the loader transfer conveyor 78. As illustrated in FIGS. 22 and 30, the intermediate containers 82 are attached to the loader transfer conveyor 78 in the same maimer as the engaging carriages 102 are attached to the tray transport conveyor 86, except that the intermediate containers 82 are rigidly affixed to the mounting brackets 118 by attachment plates 142 extending from the ends of the intermediate containers 82.

Similar to the engaging carriages 102, the intermediate containers 82 can also be mounted directly to the belt of a powered flat belt conveyor 72. If mounted on the belt of the powered flat belt conveyor 72, the body design of the intermediate container 82 would provide for the attachment of the intermediate containers 82 to the belt of the conveyor 72 and to prevent any mechanical mechanisms on the intermediate containers 82 from interfering with the powered flat belt conveyor 72.

As shown in FIG. 20, the intermediate containers 82 of the loader transfer conveyor 78 may consist of solid containers 144 or, if the cartridges 70 used for processing are smaller than the mail trays 68 being unloaded into the intermediate containers 82, the intermediate containers 82 may be designed to split the stack of mail 66 into two stacks for the subsequent deposit of the mail stacks 67 into two separate cartridges 70 as illustrated in FIG. 1.

Each intermediate container 82 designed to split the mail stack 67 into two stacks comprises a mail compressing system 148, a mail dividing system 150 and a width adjustment system 152. The mail compressing system 148 compresses the mail 66 toward the front wall 180 of the container 82. The mail dividing system 150 then takes all the mail 66 in excess of the amount of mail 66 that can be deposited into one cartridge 70 and separates that excess mail 66 into a separate stack for deposit in a second cartridge 70. The width adjustment system 152 adjusts the width of the side walls 164 of the intermediate container 82 so that the side walls 164 of the intermediate container 82 can envelop the top of a mail tray 68 and then also fit within the walls of a processing cartridge 70. A detailed description of the mail compressing system 148, mail dividing system 150 and the width adjustment system 152 is found below.

a. Mail Compressing System 148

The mail compressing system 148 of the present invention is shown in FIGS. 22 through 34. The mail compressing system 148 of the intermediate container 82 comprises (1) a paddle 154; (2) a shaft housing 156; (3) a paddle drive shaft 158; (4) a belt 168; and (5) a drive mechanism 170. As seen in FIGS. 22 through 34, the paddle 154 extends across the width of the intermediate container 82 between the side walls 164 of the intermediate container 82. Initially, when the intermediate container 82 first receives the mail 66, the paddle 154 acts as the rear wall of the intermediate container 82. Thus, all the mail 66 is deposited between the paddle 154 and the front wall 180 of the intermediate container 82.

As seen in FIGS. 22 through 25, the intermediate container 82 has a longitudinal slot 160 in the base 162 of the intermediate container 82 that runs along the longitudinal axis of the intermediate container 82 at its center. The longitudinal slot 160 begins near the front wall 180 of the intermediate container 82 and extends the approximate length of the side walls 164 of the intermediate container 82. This longitudinal slot 160 allows for the movement of the paddle 154 forward and backward along the intermediate container 82.

Figure 34:
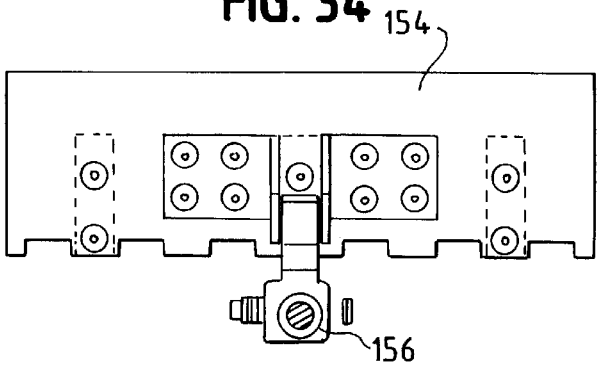
FIG. 34 is a rear view of the paddle and shaft housing of the mail compressing system of the present invention.

As seen in FIGS. 30, 31 and 34, the paddle 154 is pivotally connected to a shaft housing 156 (FIG. 31) by a formed bracket 176. As illustrated in FIG. 31, the shaft housing 156 extends from the surface of the base 162 of the intermediate container 82, where it pivotally connects to the paddle 154, through the longitudinal slot 160 in the intermediate container 82. Directly underneath the longitudinal slot 160 in the intermediate container 82 is a shaft 158, which extends the approximate length of the intermediate container 82, and, as shown in FIG. 31, is attached to the underside of the intermediate container 82 by shaft hangers 166 positioned just before and just after the ends of the longitudinal slot 160.

As shown in FIG. 31, gears or sprockets 172 are located just beyond each end of the shaft 158 and maintained against the underside of the intermediate container 82 by brackets. These gears 172 drive a belt 168 that is attached to the shaft housing 156. The belt 168 completely encompasses and rotates about the shaft 158, shaft housing 156 and the shaft hangers 166. Because the belt 168 is attached to the shaft housing 156, the belt 168, as it rotates, moves the shaft housing 156 along the shaft 158 which in turn moves the paddle 154 forward and rearward along the intermediate container 82. When the paddles 154 move forward, this causes any mail 66 between the paddle 154 and front wall 180 to be compressed against the front wall 180 of the intermediate container 82.

Figure 33:
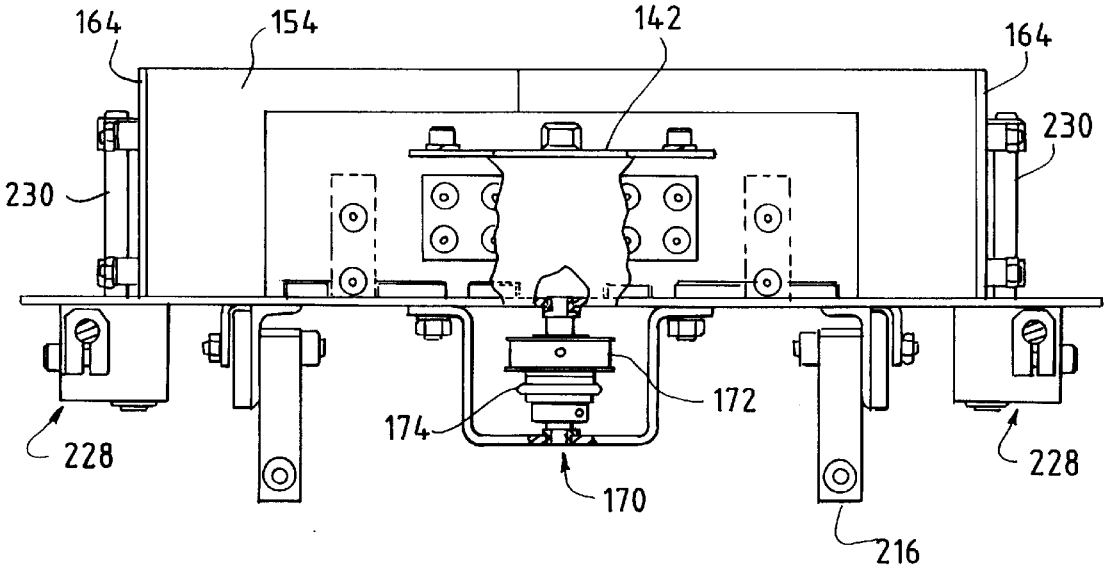
FIG. 33 is a rear view of the intermediate container illustrated in FIG. 29.

As seen in FIGS. 22 and 33, the gears 172 of this mail compressing system 148 are driven by a rubber pulley 174 sharing the same drive shaft as the rear gear 172 of the intermediate container 82. The rubber pulley 174 engages a guide rail 178 (FIG. 22) located at predetermined points along the tracks 108 of the loader transfer conveyor 78. When engaged, the rubber pulley 174 rotates, causing the rear gear 172 to rotate and move the belt 168 about the mail compressing system 148. The rubber pulley 174 and rear gear 172 mechanism are also equipped with a slip clutch (not shown) to adjust the compressive force that exerts on the mail stack 67.

In operation, the rubber pulley 174 comes in contact with a guide rail 178 shortly after mail 66 is deposited from a mail tray 68 into an intermediate container 82. This guide rail 178 then rotates the rubber pulley 174 in the direction that causes the paddle 154 to move forward along the intermediate container 82 and compress the mail 66, within the pressure parameters established by the slip clutch. After the mail 66 in the intermediate container 82 is emptied into a cartridge 70, a second guide rail 178 will engage the rubber pulley 174 to rotate the rubber pulley 174 in the opposite direction to retract the paddle 154 to its home position toward the rear of the intermediate container 82.

Additionally, the paddle 154 may be designed with a signal flag (not shown) that can be used to measure the amount of mail 66 in a given intermediate container 82 and then communicate that information with the loader cartridge section 80 so that the loader cartridge section 80 can determine whether to send one or more cartridges 70 to meet the intermediate container 82. To determine the amount of mail 66 in a intermediate container 82, this signal flag may be positioned to block a sensor pair, running perpendicular to the direction of intermediate container 82 movement, at a predetermined point along the loader transfer conveyor 78. After blocking the first sensor pair, the signal flag blocks a second sensor pair that is positioned at an angle relative to the track conveyor. Since the intermediate containers 82 will run at a constant linear velocity, the amount of mail 66 in an intermediate container 82 can be determined by the amount of time it take for the signal flag to block the second sensor pair relative to the first.

With this information, the loader cartridge section 80 can not only determine whether to send one or more cartridges 70 to meet the intermediate container 82 but can also determine the necessary positioning of an adjustable paddle 175 in each cartridge 70. As seen in FIG. 1, each cartridge 70 may be designed with an adjustable paddle 175 that adjusts the volume of space in each cartridge 70 dedicated to receive the mail pieces 66. Thus, by knowing in advance the amount of mail 66 to be deposited in each cartridge 70, the loader cartridge section 80 can adjust the paddle 175 in each cartridge 70 according the amount of mail 66 to be transferred from an intermediate container 82 into the cartridge 70.

Finally, the intermediate container 82 may also be equipped with a mechanism that prevents the mail dividing system 150 from attempting to divide a mail stack 67 when there is not enough mail 66 in the intermediate container 82 to warrant a division of the mail stack 67. This could be triggered through the same mechanism used above to communicate with the loader cartridge section 80 or could be accomplished mechanically by preventing the mail dividing system 150 from activating if the paddle 154, as it compresses the mail stack 67, passes a certain point on the base 162 of the container 82.

b. Mail Dividing System 150

The mail dividing system 150 of the present invention is illustrated throughout FIGS. 23 through 46. The mail dividing system 150 generally comprises a separating platform 182 and a finger assembly 184, which function together to separate the mail 66 into separate stacks 67 for the subsequent deposit of the mail 66 into two separate cartridges 70.

Figure 35:
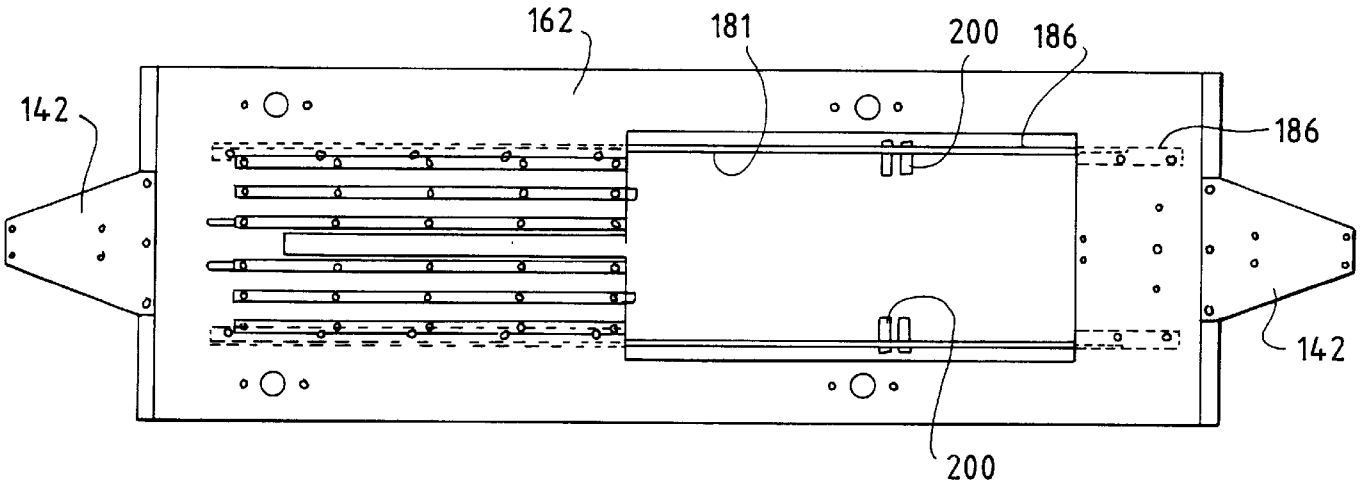
FIG. 35 is a plan view of the base of the intermediate container of the present invention.
Figure 36:
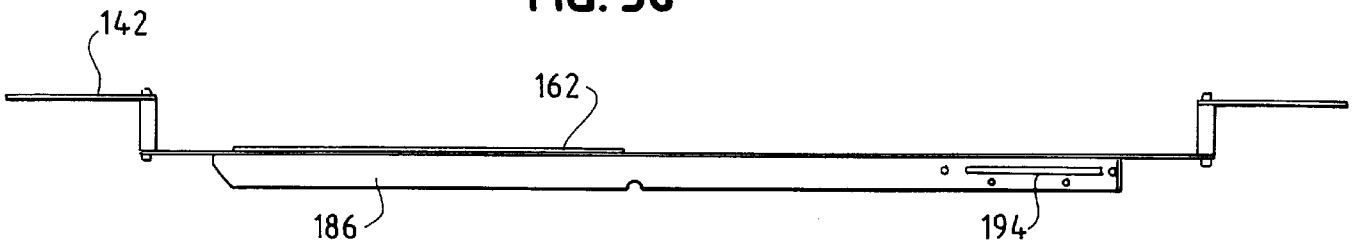
FIG. 36 is a side view of the base of the intermediate container illustrated in FIG. 35.
Figure 37:
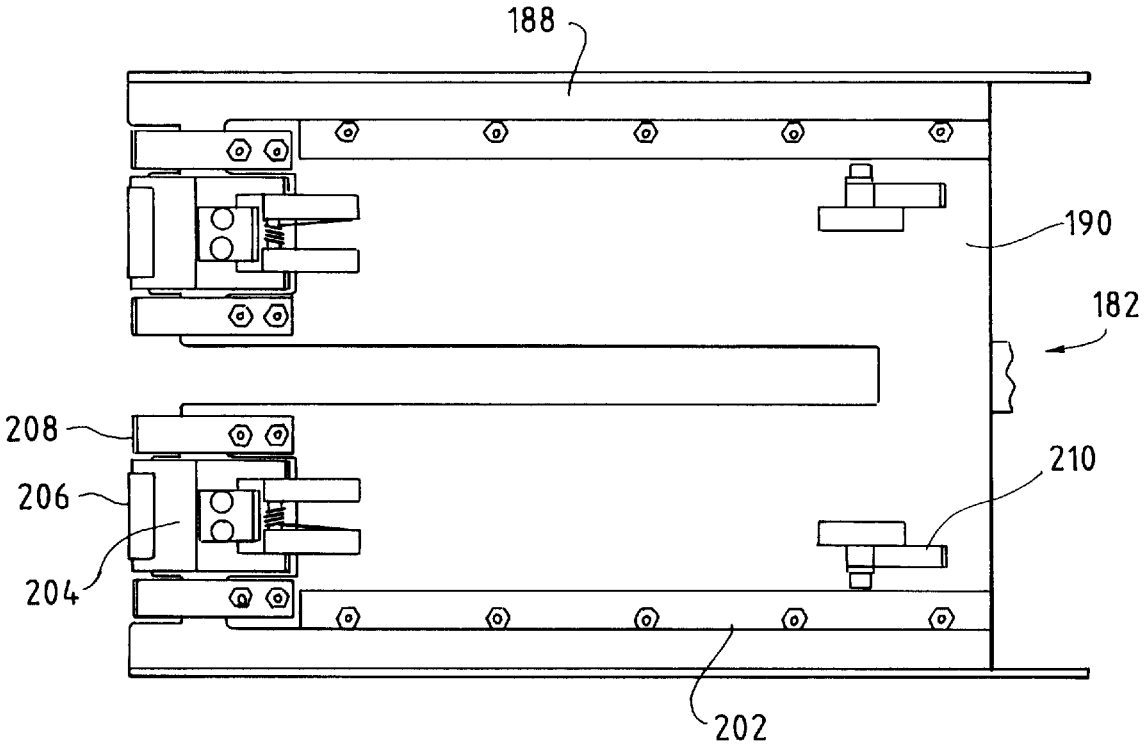
FIG. 37 is a bottom view of the mail dividing mechanism of the present invention.
Figure 38:
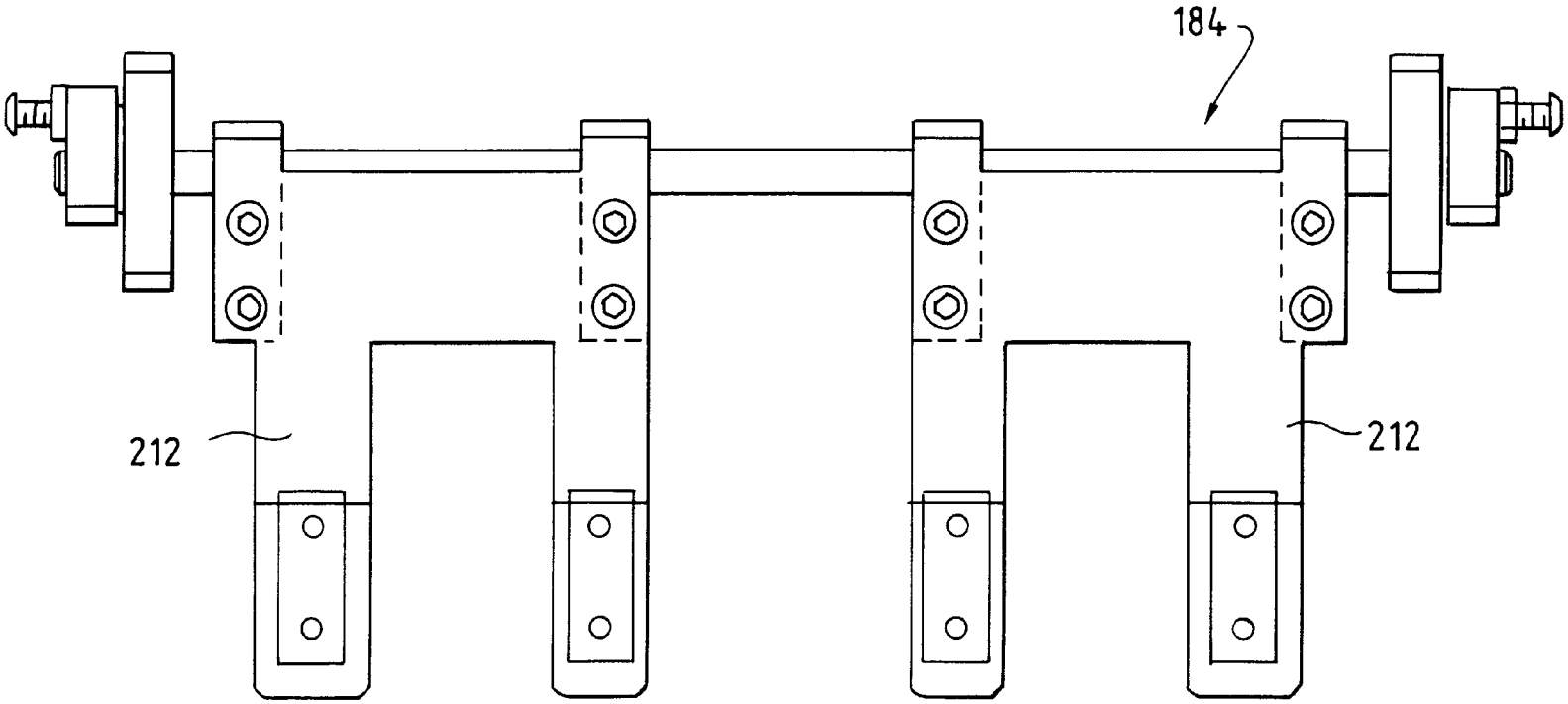
FIG. 38 is a plan view of the finger plate assembly of the mail dividing mechanism as illustrated in FIG. 37.

As seen in FIGS. 35 and 36, the intermediate container 82 of the present invention is designed to have an opening 181 in the rear portion of the container 82 for housing the separating platform 182 of the dividing system 150. As also seen in FIGS. 25, 26, 35 and 36, the intermediate container 82 has two angular brackets 186 that are positioned parallel to one another and span almost the entire longitudinal length of the container 82. As seen in FIG. 25, these brackets 186 are each positioned on the underside of the intermediate container 82 so that they are just within the longitudinal edges of the opening in the rear of the container 82 and exposed by the opening. As illustrated in the drawings, it is these angular brackets 186 that slideably mount and maintain the separating platform 182 in relation to the base 162 of the intermediate container 82.

Figure 23:
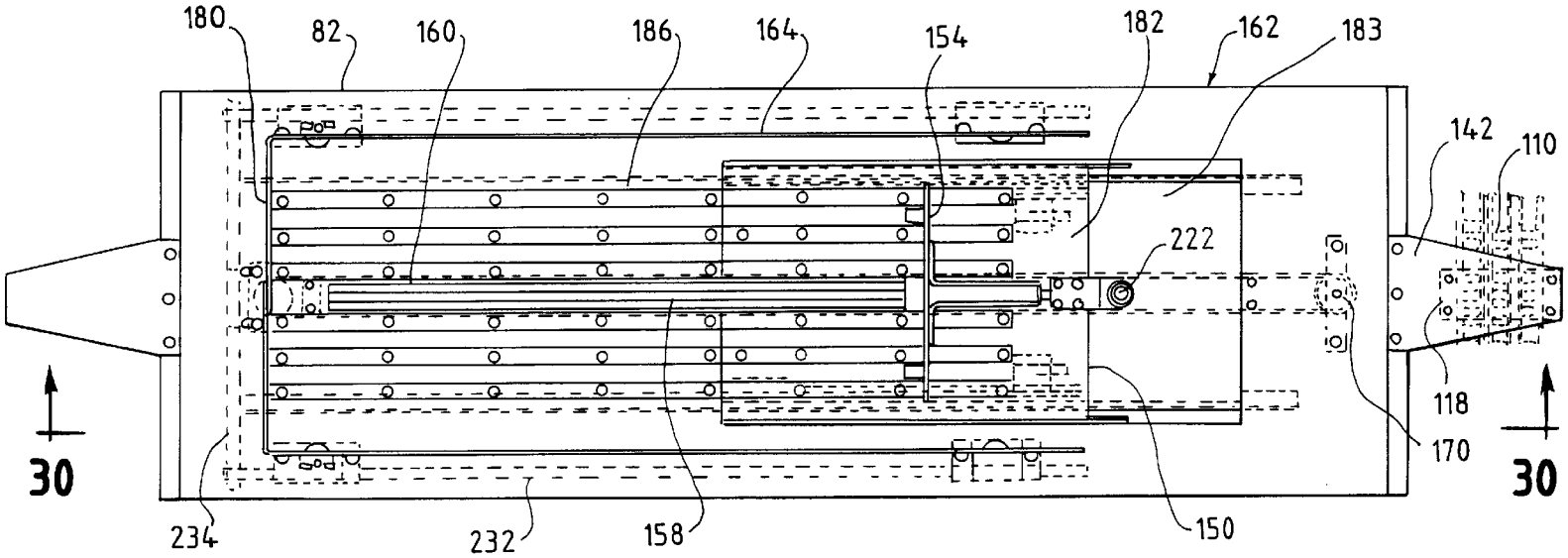
FIG. 23 is an enlarged plan view of the intermediate container illustrated in FIG. 21.

FIG. 23 illustrates a plan view of the intermediate container 82 as it appears with the separating platform 182 housed in the rear opening of the container 82. As also illustrated by FIG. 23, the separating platform 182 does not span the entire length of the rear opening in the container 82 when held within the intermediate container 82. Rather, a space 183 is intentionally left behind the separating platform 182 so that the platform 182 can retract away from its original position toward the rear of the container 82 to separate one mail stack 67 from the other.

Figure 39:
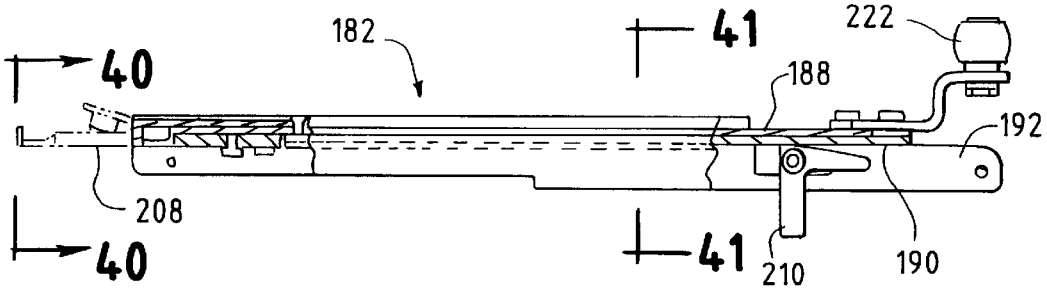
FIG. 39 is a side view of the mail dividing mechanism illustrated in FIG. 37.
Figure 40:
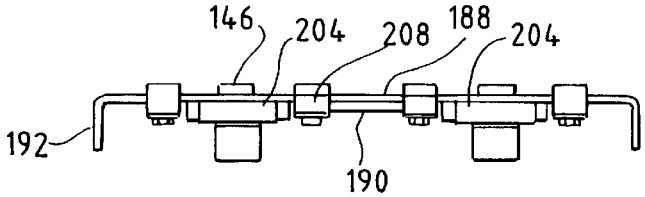
FIG. 40 is a front view of the mail dividing mechanism illustrated in FIG. 39.
Figure 41:
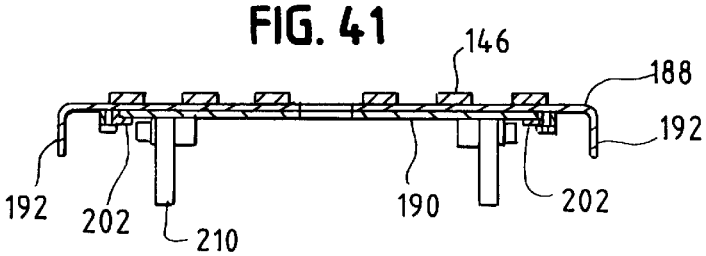
FIG. 41 is a sectional view of the mail dividing mechanism illustrated in FIG. 42 taken along line 41—41.
Figure 42:
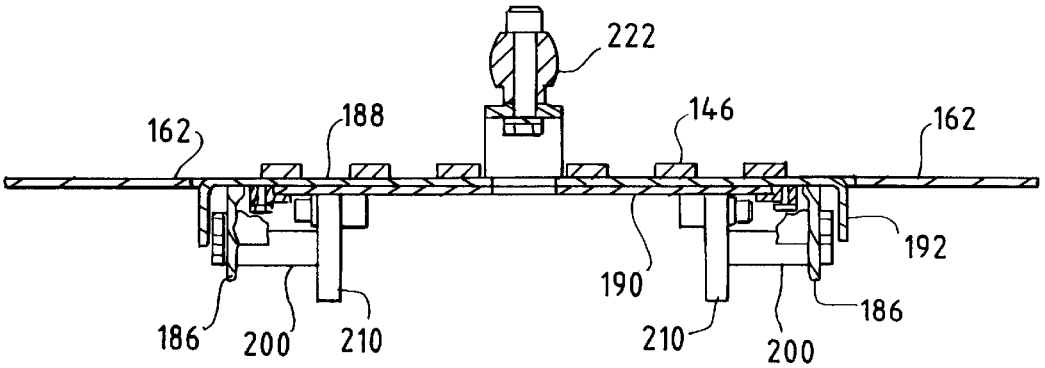
FIG. 42 is a sectional view only of the mail dividing mechanism illustrated in FIG. 30 taken along line 42—42.
Figure 43:
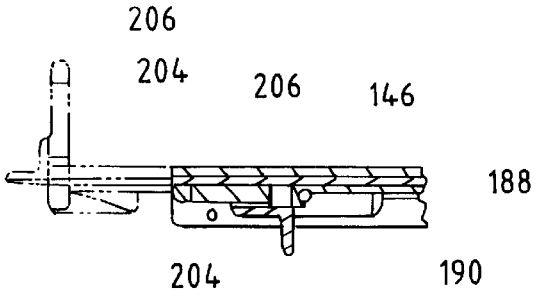
FIG. 43 is a sectional view of the mail dividing mechanism illustrated in FIG. 37 taken along line 43—43.

As best shown by FIGS. 37 through 42, the separating platform 182 is comprised of an upper plate 188 and a lower plate 190. The lower plate 190 is smaller in width than the upper plate 188 and, as illustrated by FIGS. 41 and 42, is slideably connected to the upper plate 188 by opposing guides 202 located on the underside of the upper plate 188. As seen in FIGS. 37, 39, 40 and 43, the lower plate 190 has spring loaded finger supports 204, equipped with roller tips 206, and intervening belting support bars 208 extending from the front end of the lower plate 190. Furthermore, the lower plate 190 has pivotal pawls 210 extending downward at the rear of the lower plate 190. As further explained below, these pawls 210 aid in sliding of the upper plate 188 toward the rear of the container 82 and away from the front portion of the lower plate 190 so as to expose the spring loaded finger supports 204 and belting support bars 208 used to divide the mail 66 into two stacks 67.

As illustrated in FIGS. 39 through 40, the upper plate 188 of the separating platform 182 as two opposing plate side walls 192 that extend downward toward the underside of the base 162 of the container 82. Additionally, the upper plate 188 has plastic strips 146 on its top surface that align with the plastic strips 146 located longitudinally across the base 162 of the container 82. The plastic strips 146 on the surface of the base 162 and upper plate 188 aid in the movement of mail 66 along the base 162 of the container 82. Furthermore, the upper plate 188 has a dividing cam roller 222 extending from the rear of the upper plate 188.

As seen in FIGS. 25 and 42, the width of the upper plate 188 is such that the plate side walls 192 extend just past the angular brackets 186 attached on the underside of the base 162 of the intermediate container 82. This allows the separating platform 182 to rest on the angular brackets 186 when positioned within the rear opening of the container 82.

Figure 29:
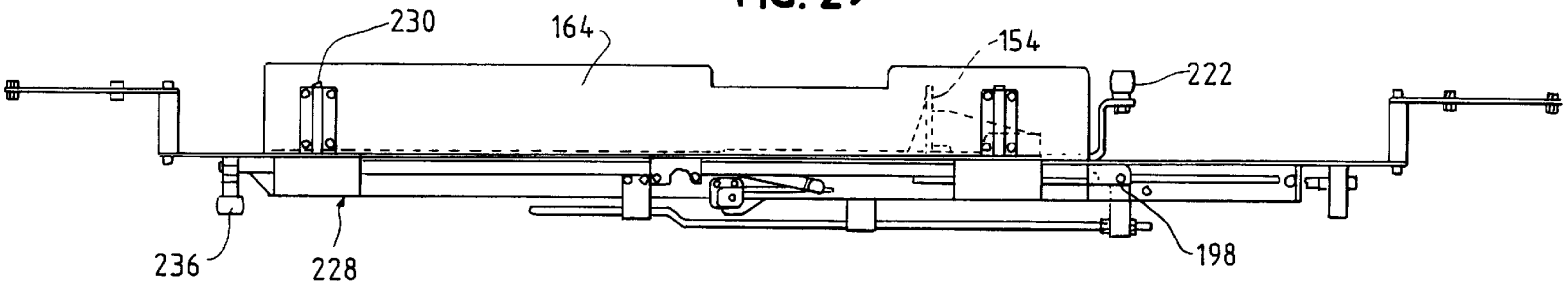
FIG. 29 is a side elevation view of the intermediate container illustrated in FIG. 23.

As illustrated in FIG. 39, the side walls 192 of the upper plate 188 have small holes for receiving a pin at the front and rear of the walls 192. The holes on each wall 192 are aligned with one another and are used to pivotally and slideably connect the separating platform 182 to the angular brackets 186 of the container 82. As shown in FIGS. 29 and 30, the separating platform 182 is connected at both sides to the angular brackets 186. The separating platform 182 is connected at its rear by a platform pin 198 extending through the hole in the side wall 192 of the upper plate 188 and through a longitudinal slot 194 at the rear of the angular bracket 186. At its front, the separating platform 182 is connected, at both sides, to the base 162 of the container 82 by a pivot arm 196. The pivot arm 196 is connected at one end to the side wall 192 of the upper plate 188 and at the other end to the angular bracket 186 of the base 162.

Figure 28:
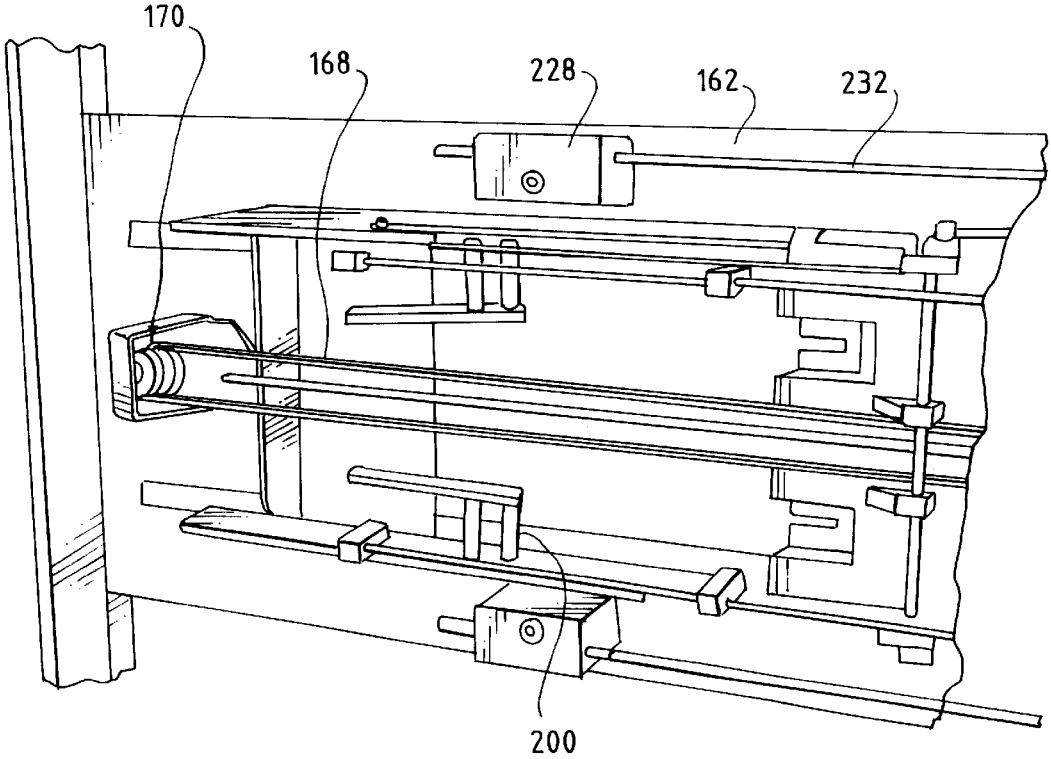
FIG. 28 is a bottom perspective view of the rear half of the intermediate container illustrated in FIG. 26.

As shown in FIG. 28, the finger assembly 184 of the mail dividing system 150 is located directly underneath the front portion of the separating platform 182 when the platform 182 is in its home position, as illustrated by FIG. 29. The finger assembly 184 includes two finger plates 212 connected together on a shaft extending through the angular brackets 186 and is pivotally connected at its ends to the underside of the base 162.

As best seen in FIGS. 28 and 29, at the rear of each finger plate 212, a portion of the plate 212 extends downward to engage a formed shaft 218. The formed shaft 218 is held on the underside of the base 162 by bearings 220 attached to the angular brackets 186 of the base 162. The shaft 218 is attached at one end to an extension bar 216 extending downward from the platform pin 198 that connects the side wall 192 of the upper plate 188 to the longitudinal slot 194 in the angular bracket 186.

As also illustrated by FIG. 28, opposing pairs of stop bars 200 extend horizontally from the interior sides of the angular brackets 186 toward the center of the base 162. The stop bars 200 are positioned on the angular brackets 186 so that they hold the pawls 210 extending downward from the lower plate 190 between the stop bars 200.

Figure 44:
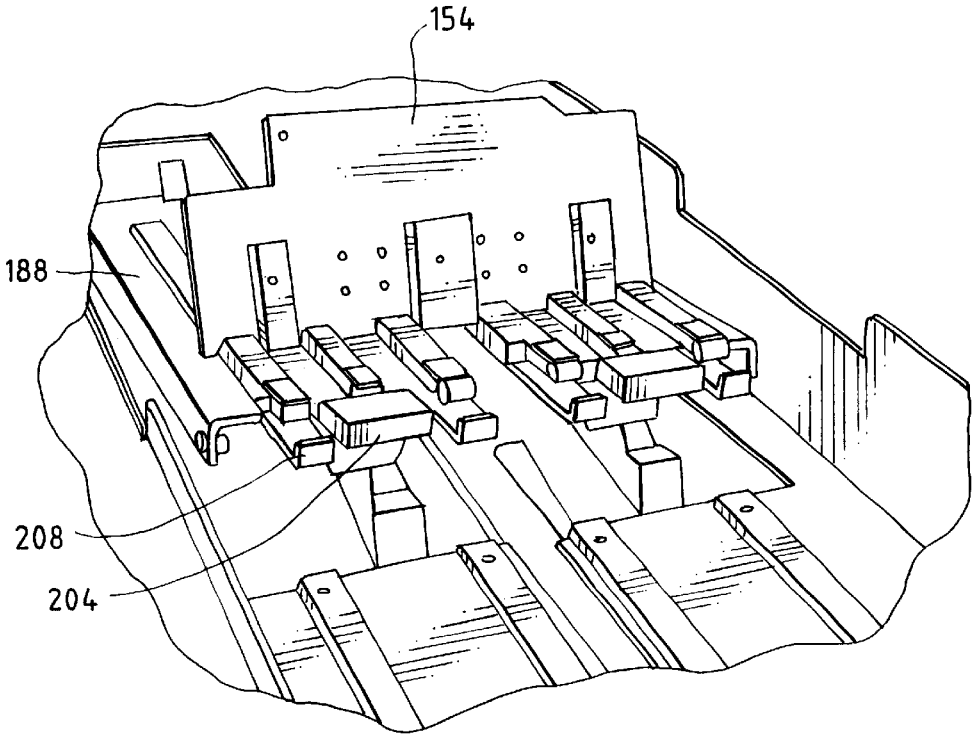
FIG. 44 is a front perspective view of the intermediate container illustrated in FIG. 24 as it would appear lifting a portion of a mail stack away from the other portion of the mail stack.
Figure 45:
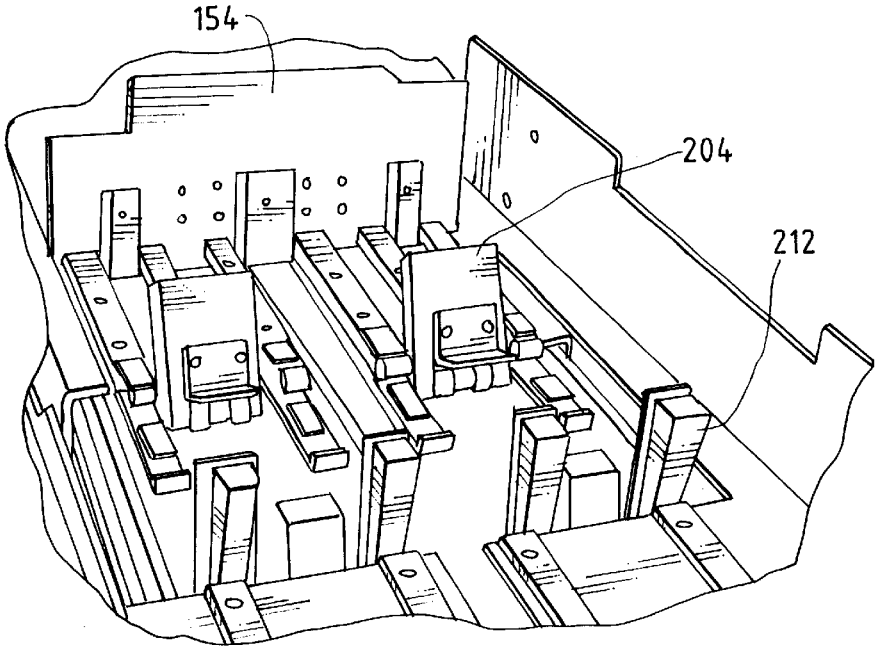
FIG. 45 is a front perspective view of the intermediate container illustrated in FIG. 24 as it would appear after it has divided the original mail stack into two separate stacks.
Figure 46:
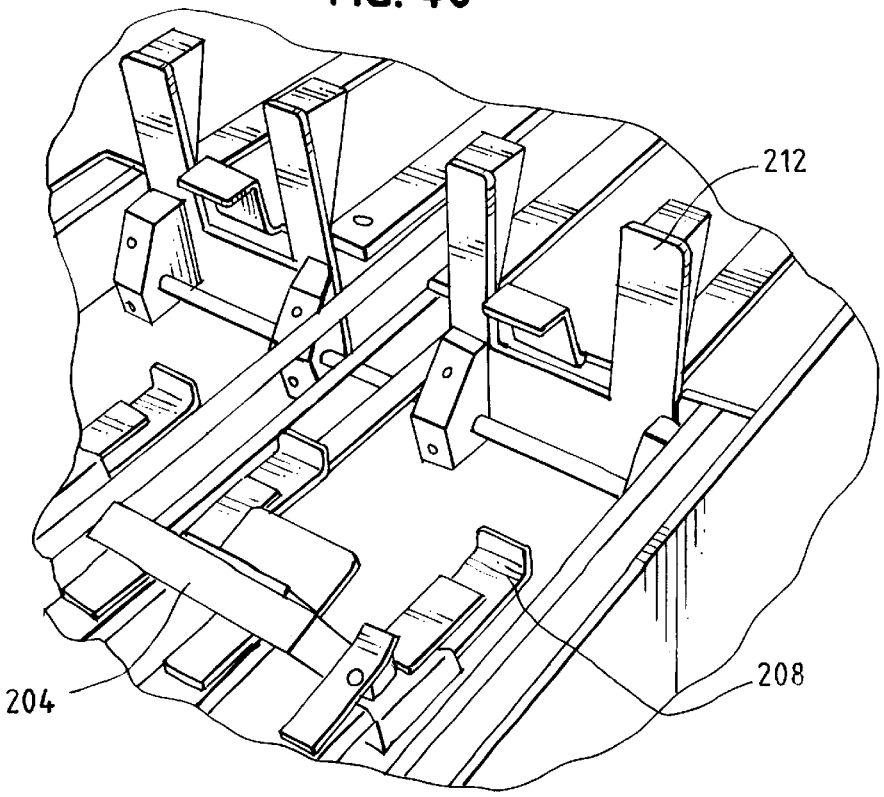
FIG. 46 is a rear perspective view of the intermediate container as illustrated in FIG. 45 taken along line 46—46.
Figure 47:
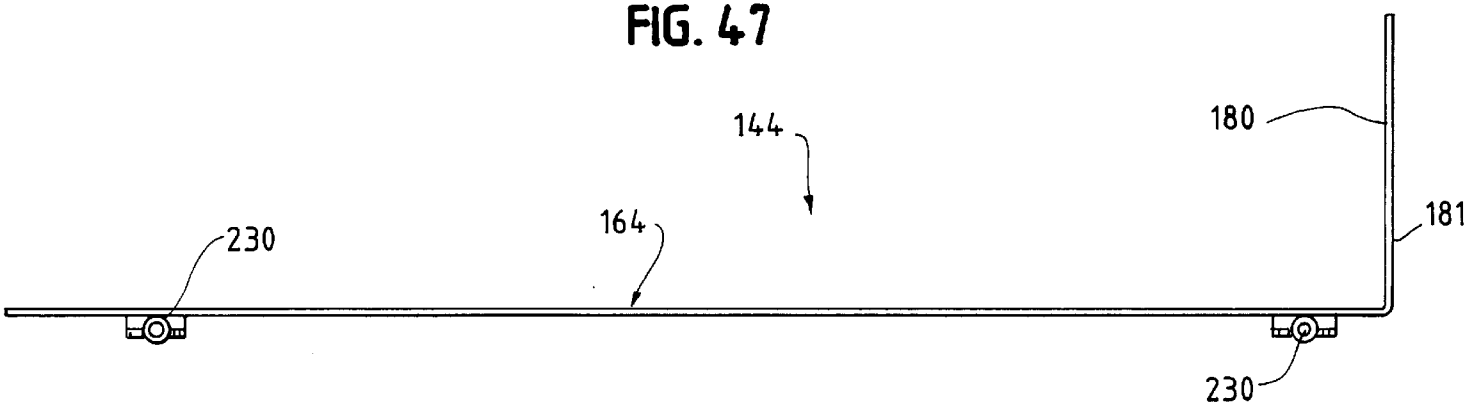
FIG. 47 is a plan view of a side wall and portion of the split front wall of the intermediate container illustrated in FIG. 23.

FIGS. 44, 45 and 47 illustrate the operation of the mail dividing system 150. In operation, the dividing cam roller 222 is forced to the rear of the container 82 by dividing guide rails (not shown) positioned on the track 108 of the loader transfer conveyor 78. As the dividing cam roller 222 is forced rearward, the upper plate 188 of the separating platform 182 is also forced toward the rear of the container 82. Because the upper plate 188 is slideably engaged at its rear along longitudinal slots 194 in the angular brackets 186, the rear of the upper plate 188 slides rearward with the dividing cam handle 222. However, because the front of the upper plate 188 is pivotally connected to the angular brackets 186 by a pivot arm 196, the front of the upper plate 188 raises in the air about the pivot point. The paddle 154 of the compressing system 148 is allowed to elevate with the upper plate 188 of the separating platform 182 since the paddle 154 is pivotally connected to the shaft housing 156 of the compression system 148. This is best illustrated by FIG. 30 and FIGS. 44, 45 and 46.

Figure 26:
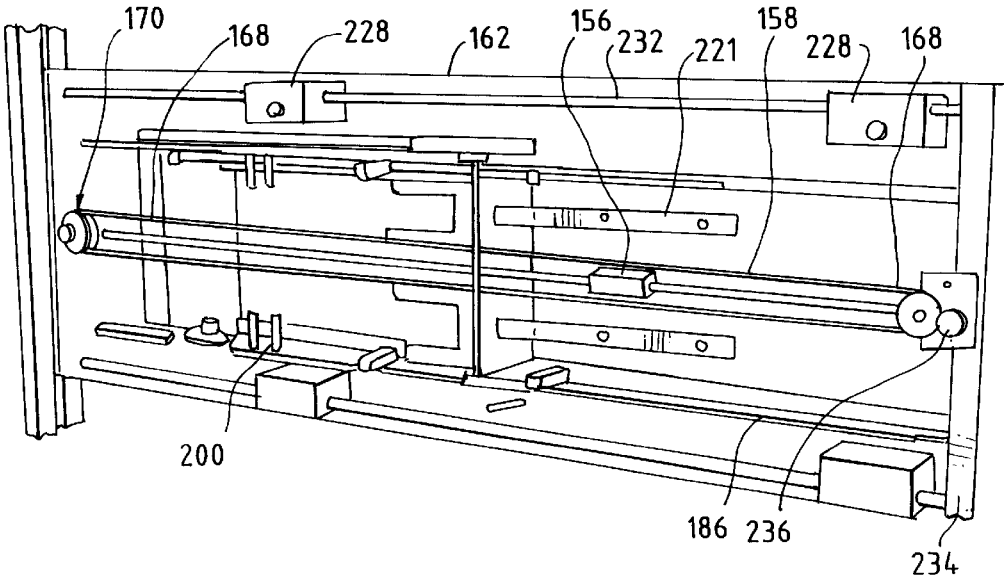
FIG. 26 is a bottom perspective view of the intermediate container illustrated in FIG. 24.
Figure 27:
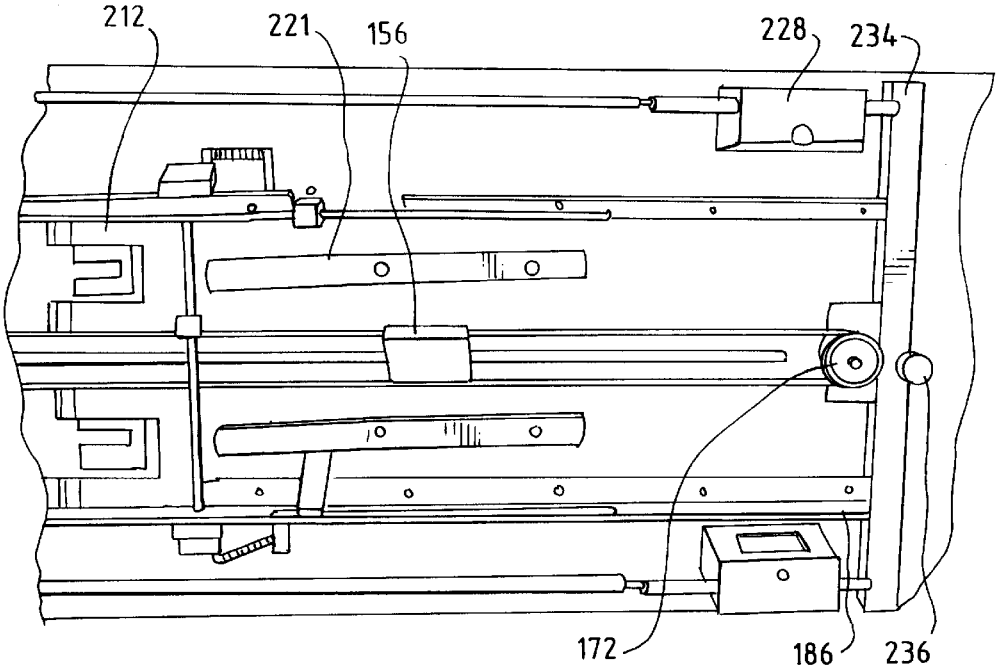
FIG. 27 is a bottom perspective view of the front half of the intermediate container illustrated in FIG. 26.

In the meantime, the lower plate 190 is being held in its original position by the pawls 210 and the stop bars 200 extending from the angular brackets 186. While the lower plate 190 is elevated with the upper plate 188, the lower plate 190 does not move rearward, and thus, the upper plate 188 is slid away from the lower plate 190 exposing the spring loaded finger supports 204 and belting support bars 208 at the front of the lower plate 190. Because the finger supports 204 are spring loaded, they rotate upward, as seen in FIG. 45, as the upper plate 188 moves away from the lower plate 190. As shown in FIGS. 25 and 26, stop arms 221 may be positioned on the underside of the lower plate 190 to stop the motion of the upper plate 188 beyond a predetermined distance relative to the lower plate 190.

Additionally, to assist in the separation of the mail 66 into two separate stacks 67, the belting support bars 208 on the lower plate 190, as seen in FIGS. 39, 44 and 45, house belting strips 209 that are slideably attached to the underside of the upper plate 188. As illustrated by FIGS. 44 and 45, when the upper plate 188 retracts away from the lower plate 190, the belting strips 209 are lifted from of their housings on the belting support bars 208 and retracted rearward, with the movement of the upper plate 188, at an angle that assists in the movement of the mail pieces 66 toward the rear of the intermediate container 82.

At the same time as the upper plate 188 is being moved to the rear of the container 82, the formed shaft 218 is also being moved to the rear of the container 82. As the shaft 218 moves toward the rear, a bend in the formed shaft 218 engages the finger plates 212 of the finger assembly 184 and forces the finger plates 212 upward, as shown in FIG. 45. As shown in FIGS. 44 and 45, stop arms 221 may also be connected to the underside of the base 162 that function to extend upward and beyond the surface of the base 162 of the intermediate container 82 when the separating platform 182 is initially retracted. These stop arms 221 help to prevent mail pieces 66 from falling through the gap created between the base 162 and separating platform 182 before the finger plates 212 contact the facing of mail pieces 66 at the front of the container 82. Extension springs 214 (FIG. 29) connected to the finger plates 212 bring the finger plates 212 back to their original position once the formed shaft 218 is disengaged by the forward movement of the shaft 218 back to its original position.

When it is desired to return the separating platform 182 and finger plates 212 to their original position, the dividing cam roller 222 is forced back to its original position. The process is reversed in its entirety and the formed shaft 218 is disengaged from the finger plates 212, retuning the finger plates 212 to their original position.

It is recognized by one skilled in the art that other dividing systems 150 may also be utilized to divide the mail stack 67 into two separate stacks 67. For example, the mail stack 67 may be divided into two separate stacks 67 by mail splitter knives (not shown) that, in addition to separating the stack 67, provide support to the back face of the mail 66 in the front portion of the container 82 and front face of the mail 66 in the rear portion of the container 82. Once the mail stack 67 is divided, it is separated by diverting the rear portion of the container 82 with a cam mechanism.

c. Width Adjustment System 152

Additionally, to assist in the transfer of the mail 66 between the mail trays 68, intermediate containers 82 and cartridges 70, the intermediate containers 82 can also be designed to have adjustable side walls 164. By having adjustable side walls 164, the width of the intermediate containers 82 can be widened to envelop the mail trays 68 and subsequently reduce the width of the intermediate containers 82 to fit within the cartridges 70. By having the intermediate containers 82 envelope the mail trays 68, the transfer of the mail 66 into the containers 82 is smoother. Similarly, the transfer of the mail 66 from the containers 82 into the cartridges 70 is easier when the container walls fit within the walls 164 and 180 of the cartridges 70.

The ability to adjust the width of the side walls 164 of the intermediate containers 82 is accomplished by a width adjustment system 152 which includes two opposing overlapping L-shaped brackets 144 each comprising a side wall 164 of the container 82 and a portion of the front wall 180 of the container 82. Thus, the front wall 180 of the container 82 is split into two portions 179 and 181. As seen in FIGS.

23 and 24, the portion of the L-shaped brackets 144 that form the front wall 180 of the container 82 overlap so that the first portion 179 of the front wall 180 overlaps the second portion 181 at approximately the center of the front wall 180. This overlapping of the two portions 179 and 181 allows the length of the front wall 180 to increase as the side walls 164 move away from one another and decrease as the side walls 164 move toward one another. An illustration of an L-shaped bracket 144 is found in FIG. 47.

Figure 48:
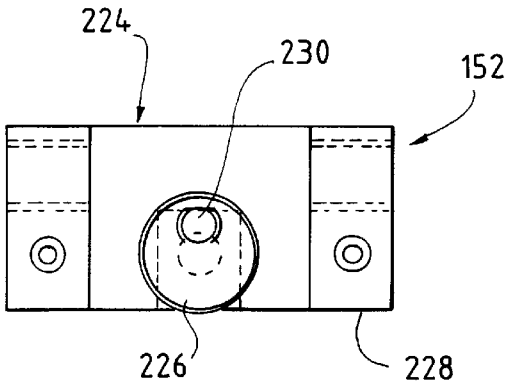
FIG. 48 is a plan view of the pinion housing of the width adjustment mechanism of the intermediate container of the present invention.
Figure 49:
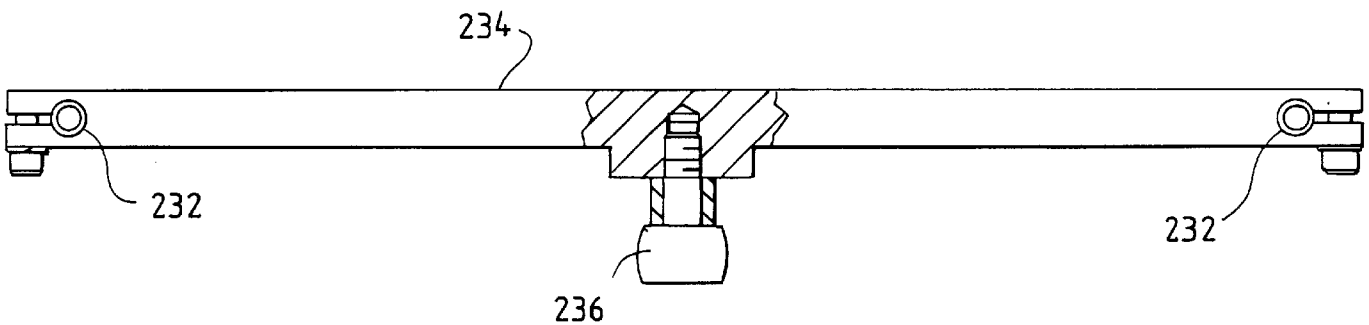
FIG. 49 is a front view of the cross bar assembly of the width adjustment mechanism of the intermediate container of the present invention.

As shown in FIGS. 33 and 47, each side wall 164 of the present invention is attached to the base 162, at its sides, by rotating rods 230. As illustrated by FIG. 33, each rotating rod 230 is attached to the exterior facing side of each side wall 164 by brackets 144. As seen in FIG. 48, each rotating pinion shaft 226 is set in an eccentric mechanism 224. The eccentric mechanism 224 is a round disk that rotates in both the clockwise and counter-clockwise direction and is set in the base 162 of the container 82 to be flush with the base 162.

As further shown by FIG. 48, each rotating rod 230 is set off-center in the eccentric mechanism 224 so that when the eccentric mechanism 224 is rotated, the rotating rod 230 is moved vertically either forward or backward. Because each rotating rod 230 is affixed to the side wall 164 of the present invention, the movement of rotating rods 230 causes the side wall 164 of the container 82 to move both forward or backward in the vertical position.

Figure 51:
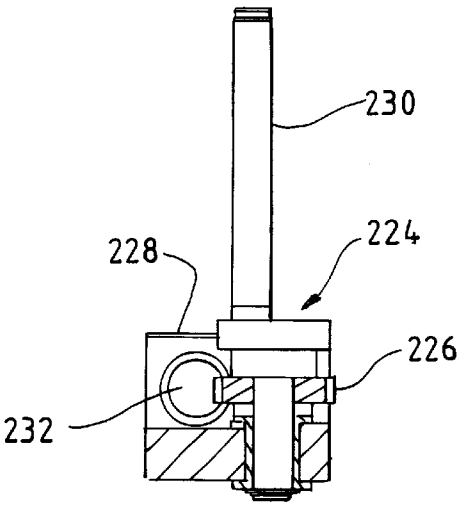
FIG. 51 is a front view of the pinion housing illustrated in FIG. 48.
Figure 50:
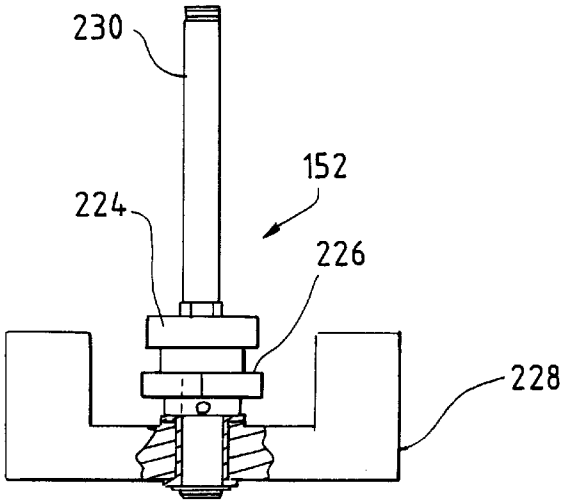
FIG. 50 is a side view of the pinion housing illustrated in FIG. 48

Directly underneath the eccentric mechanism 224 is a pinion 226, which is driven in both the clock-wise and counter-clockwise direction by a rack 232. As illustrated by FIGS. 50 and 51, the pinion 226 and eccentric mechanism 224 are housed in a pinion housing 228 that is affixed to the underside of the base 162. The pinion housing 228 has an elongated opening for receiving and maintaining the positioning of a rack 232 against the pinion 226. Attached to the front end of each rack 232 is a cross bar assembly 234 that has an adjustment cam roller 236. The adjustment cam roller 236 is designed to contact an adjustment guide rail 238 located on the track of the loader transfer conveyor 78, as seen in FIG. 22, to move the cross bar assembly 234 and rack 232 in a forward and rearward motion. This forward and rearward motion of the rack 282 rotates the pinion 236 and eccentric mechanism 224, causing the side walls 164 to move in opposing directions relative to one another.

As seen in FIG. 22, the eccentric mechanisms 224 are positioned directly underneath each side wall 164. When the side walls 164 are in their home position, the rotating rods 230 are all positioned on the eccentrical mechanisms 224 toward the exterior edges of the base 162 of the container 82.

In operation, the side walls 164 of the intermediate container 82, when in their home position, are at their greatest width and able to envelop a mail tray 68. Once the mail 66 is loaded in the intermediate container 82, the width of the side walls 164 must then be decreased to fit within the side walls 164 of the processing cartridge 70. Thus, prior to approaching the cartridge transport conveyor 250, the adjustment cam roller 236 on the cross bar assembly 234 is engaged by an adjustment guide rail 238 extending from the upper track 108 of the loader transfer conveyor 78. This adjustment guide rail 238 is formed to force the cross bar assembly 234 forward, causing the racks 232 under each side wall 164 to rotate the pinions 226 and eccentric mechanisms 224. To move both walls 164 vertical toward the center of the container 82, the eccentric mechanisms 224 on side wall 164 are rotated in the clockwise direction and the eccentric mechanisms 224 on the opposing side wall 164 are rotated in the counterclockwise direction to move all the rotating rods 230 so that they are positioned toward the front wall 180 of the container 82.

After the mail 66 is deposited into the processing cartridges 70, the side walls 164 of the container 82 are then moved back to their home position by a second adjustment guide rail 238 located on the lower track 108 of the loader transfer conveyor 78 that forces the adjustment cam roller 236 and cross bar assembly 234 rearward. Moving the bar assembly 234 rearward rotates the pinions 226 and eccentric mechanism 224 so that the rotating rods 230 are again positioned toward the exterior edges of the container 82.

It is recognized by one skilled in the art that the amount of movement of the side walls 164 is dictated by the diameter of the eccentric mechanism 224 and the positioning of the rotating rod 230 on the eccentric mechanism 224. Thus, if a larger range of movement between the side walls 164 is required, a larger diameter eccentric mechanism 224 is utilized and the rotating rod 230 is positioned as near the circumference of the eccentric mechanism 224 as possible. Similarly, it is recognized that positioning of the eccentric mechanism 224 and rotating rod 230, relative to the side walls 164 may vary as well as the home positions of the opposing eccentric mechanism 224 without effecting the overall functionality of the width adjustment system 152.

3. Loader Cartridge Section 80

Figure 52:
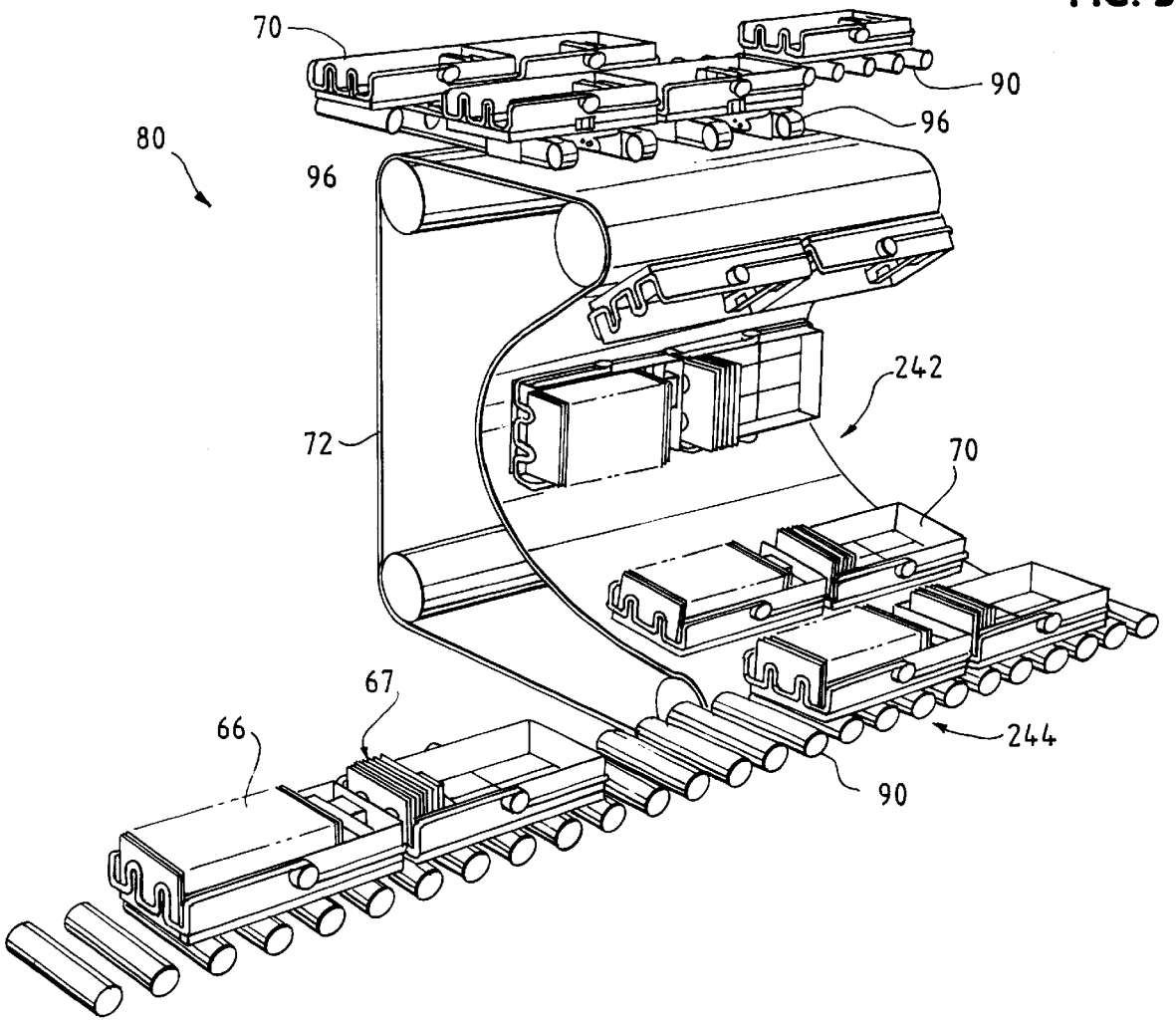
FIG. 52 is a front perspective view of the loader cartridge section of the present invention as illustrated in FIG. 1.
Figure 53:
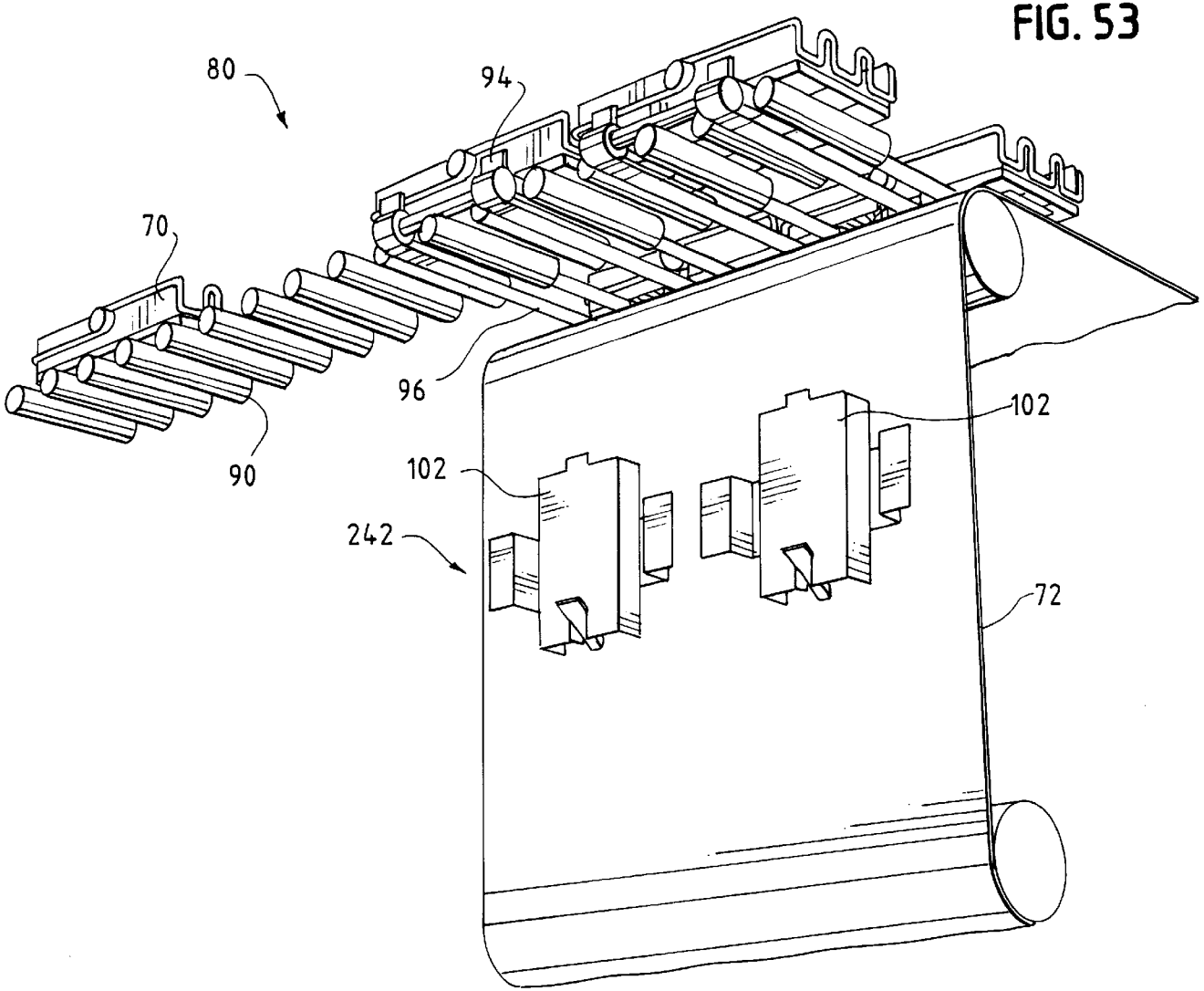
FIG. 53 is a rear perspective view of the loader cartridge section illustrated in FIG. 52.

As shown in FIGS. 1 and 52, the loader cartridge section 80, similar to the loader tray section 76, comprises three components: (1) a cartridge input conveyor 240; (2) a cartridge transport conveyor 242; and (3) a cartridge output conveyor 244. The loader cartridge section 80 of the present invention is very similar to the loader tray section 76 of the present invention, except that it operates in the opposite direction. The loader tray section 76 receives empty cartridges 70 from the TMS via the cartridge input conveyor 240, engages and transports the cartridges 70 along the cartridge transport conveyor 242 where the cartridges 70 are interfaced with the intermediate containers 82 to receive mail 66, and then transported to an intermediary processing operation 93 (FIG. 54) via the cartridge output conveyor 244. Substantially the same component parts found on the loader cartridge section 80 are present on the loader tray section 76, and therefore, only a brief discussion of the three component parts of the loader cartridge section 80 is found below.

a. Cartridge Input Conveyor 240

As discussed previously, empty cartridges 70 are supplied to the cartridge input conveyor 240 by the TMS and are carried to the cartridge transport conveyor 242 on a powered roller conveyor 90. The powered roller conveyor 90 transports the empty cartridges 70 to an area adjacent to and atop the cartridge transport conveyor 242. As seen in FIG. 1, the cartridge input conveyor 240 brings the cartridges 70 to the cartridge transport conveyor 242 open end first with the open end registered to one side to coincide with the edge of the cartridge transport conveyor 242.

Upon receiving information from the loader transfer conveyor 78 regarding the need for a cartridge 70 and the number of cartridges 70 required (one or two), the cartridge input conveyor 240 actuates a pusher finger 94 on finger belt conveyor 96 to advance the cartridges 70 onto the cartridge transport conveyor 242 in synchronization with an engaging carriage 102 located on the cartridge transport conveyor 242.

b. Cartridge Transport Conveyor 242

Similar to the tray transport conveyor 86, the cartridge transport conveyor 242 consists of a series of engaging carriages 102 located at fixed pitch points along the conveyor 242. The engaging carriages 102 on the cartridge transport conveyor 242 are the same construction as the engaging carriages 102 on the tray transport conveyor 86 and are therefore designated by the same reference number. Likewise, the engaging carriages 102 are affixed to the conveyor 242, regardless of type of conveyor, in the same manner as they are affixed to the tray transport conveyor 86, described above.

The engaging carriages 102 of the cartridge transport conveyor 242 engage and maintain each cartridge 70 in pivotal attachment with the cartridge transport conveyor 242 in the same manner as the engaging carriages 102 maintain the mail trays 68 on the tray transport conveyor 86. The only difference between the cartridge transport conveyor 242 and the tray transport conveyor 86 is the location where the cartridge 70 and mail trays 68 are engaged and the number of engaging carriages 102 utilized on the conveyor 242.

In a case where the mail stack 67 is not split, only one cartridge 70 is transferred to the cartridge transport conveyor 242. However, in a case where mail 66 will not fit into one cartridge 70, two cartridges 70 will be advanced toward the cartridge transport conveyor 242. Therefore, two engaging carriages 102, or one engaging carriage 102 having multiple engaging mechanisms 100, are required.

As the cartridges 70 move along the cartridge transport conveyor 242, mail 66 is transferred from the intermediate containers 82 on the loader transfer conveyor 78 to the cartridges 70 on the cartridge transport conveyor 242. After receiving the transferred mail 66, the cartridges 70 are then conveyed to the cartridge output conveyor 244. However, before transfer of the cartridge output conveyor 244, the gripper paddle 130 on the engaging carriage 102 is released and pivoted downward to allow the cartridge 70 to be transferred to the discharge section.

c. Cartridge Output Conveyor 244

The cartridge output conveyor 244 consists of a powered roller conveyor 90 that receives the loaded cartridges 70 from the cartridge transport conveyor 242. A finger belt conveyor 96 with pusher fingers 94 is used to move the cartridge(s) 70 quickly away from the cartridge transport conveyor 242 to make room for the next incoming cartridge (s) 70. Once on the cartridge output conveyor 244, the loaded cartridges 70 are then passed to the intermediary processing operation 93 via a powered roller conveyor 90.

B. Cartridge Unloader 64

As seen in FIGS. 3 and 4, the cartridge unloader 64, similar to the cartridge loader 62, consists of an unloader cartridge section 246, an unloader transfer conveyor 254 and an unloader tray section 256. As mentioned previously, the cartridge unloader 64 operates substantially like the cartridge loader 62, except that the intermediate containers 82 of the cartridge unloader 64 do not include a device to divide the mail 66 into two stacks. All the other component parts, however, on the cartridge unloader 64 are found on the cartridge loader 62 and have been described in detail above. Because substantially all of the parts in the cartridge unloader 64 are present in the cartridge loader 62, the same reference numbers will be used to represent corresponding parts and only a brief discussion of the cartridge unloader 64 and its component parts is found below.

1. Unloader Cartridge Section 246

As seen in FIGS. 3 and 4, the unloader cartridge section 246 operates substantially like the loader tray section 76 of the cartridge loader 62, except that the unloader cartridge section 246 transports cartridges 70, rather than trays 68. The unloader cartridge section 246 can be broken into three component parts: (1) a cartridge input conveyor 248; (2) a cartridge transport conveyor 250; and (3) a cartridge output conveyor 252.

The cartridge input conveyor 248 feeds individual cartridges 70 containing processed mail 66 to the cartridge transport conveyor 250 via a powered roller conveyor 90. The cartridges 70 on the cartridge input conveyor 248 are aligned with the cartridge transport conveyor 250 and advanced toward the conveyor 250 by a finger belt conveyor 96 having pusher fingers 94 which operate at the properly synchronized time. The cartridges 70 are then engaged by an engaging carriage 102 located on the cartridge transport conveyor 250. Once engaged, the cartridges 70 are moved to a position where they are enveloped by an intermediate container 82 on the unloader transfer conveyor 254, and inverted 180 degrees so that the mail 66 inside the cartridges 70 is deposited into the intermediate container 82 under the influence of gravity. After the mail 66 has been transferred from the cartridges 70 to the mail trays 68, the empty cartridges 70 are released from the engaging carriage 102 and transported to the cartridge output conveyor 252.

The cartridge output conveyor 252 has a finger belt conveyor 96 with pusher fingers 94 for advancing the empty cartridge 70 onto a powered roller conveyor 90 that transports the empty cartridge 70 back to the TMS.

2. Unloader Transfer Conveyor 254

The unloader transfer conveyor 254 operates substantially like the loader transfer conveyor 78 and has all the same components parts as the loader transfer conveyor 78, except that the intermediate containers 82 are not equipped with a mail dividing system 150. The mail 66 being deposited into the intermediate containers 82 is transferred from the intermediate containers 82 back into mail trays 68, and thus there is no need for a mail dividing system 150 in the intermediate containers 82 of the unloader transfer conveyor 254. The compressing system 148 and width adjustment system 152, previously described, however, are both incorporated into the intermediate container 82 of the unloader transfer conveyor 254.

Additionally, the adjustment of the width of the side walls 164 must be made so that the side walls 164 of the intermediate container 82 envelop the cartridge 70. Subsequently, the width between the side walls 164 must be adjusted so that the side walls 164 of the intermediate container 82 fit within the mail tray 68. This requires the positioning of the adjustment guide rails 238 on the track 108 of the unloader transfer conveyor 254 to be modified as compared to the loader transfer conveyor 78.

Similar to the loader transfer conveyor 78, the unloader transfer conveyor 254 can have a signal flag (not shown) attached to the paddle 154 of the compressing system 148 that can determine, through the use of a series of sensor pairs, the amount of mail 66 in the intermediate container 82. A mail tray 68 that meets the size requirements of the mail stack 67 in the container 82 can be selected by the unloader cartridge section 246 for interfacing with the intermediate container 82.

3. Unloader Tray Section

As seen in FIGS. 3 and 4, the unloader tray section 256 operates substantially like the loader cartridge section 80 of the cartridge loader 62, except that the unloader tray section 256 transports trays 68, rather than cartridges 70. Like the loader cartridge section 80, the unloader tray section 256 can be broken into three component parts: (1) a tray input conveyor 258; (2) a tray transport conveyor 260; and (3) a tray output conveyor 262.

The tray input conveyor 258 feeds empty mail trays 68 to the tray transport conveyor 260 via a powered roller conveyor 90 positioned atop the tray transport conveyor 260. The trays 68 on the tray input conveyor 258 are aligned with the tray transport conveyor 260 and advanced toward the conveyor 260 by a finger belt conveyor 96 having pusher fingers 94 at the properly synchronized time. The trays 68 are then engaged by an engaging carriage 102 located on the tray transport conveyor 260. Once engaged, the trays 68 are inverted to envelop the intermediate container 82 and receive the processed mail 66 in the intermediate container 82 on the unloader transfer conveyor 254. After the mail 66 has been transferred from the containers 82 to the mail trays 68, the mail trays 68 are then released from the engaging carriage 102 and transferred to the tray output conveyor 262.

The tray output conveyor 262 has a finger belt conveyor 96 with pusher fingers 94 for advancing the filled mail trays 68 onto a powered roller conveyor 90. The powered roller conveyor 90 then transports the mail trays 68 for delivery to their next destination While the present invention has been disclosed in reference to the disclosed embodiments, other arrangements will be apparent to those of ordinary skill in the art and are to be considered within the spirit and scope of the present invention. The invention is, therefore, to be limited only as indicated by the scope of the claims that follow and their equivalents.

What is claimed is:

1. A continuous flow transfer apparatus for transferring documents from an infeed tray to a cartridge for conveyance of the documents in the cartridge to a document processing system comprising:

a movable infeed conveyor;

means to advance infeed trays for containing documents to said infeed conveyor and releasably attach said infeed trays to said infeed conveyor;

a moving transfer conveyor to which intermediate containers are fixedly attached;

said documents being deposited into an intermediate container as an infeed tray containing said documents is advanced to an inverted position adjacent an intermediate container;

said documents being deposited from said intermediate container into a cartridge means as each said intermediate container is advanced to an inverted position adjacent said cartridge means;

a movable discharge conveyor, said cartridge means being releasably attached to said discharge conveyor, and means to release said cartridge means into which said documents have been deposited from said discharge conveyor and advance said cartridge means and said documents away from said discharge conveyor.

2. The continuous flow transfer apparatus of claim 1 wherein each said infeed tray is releasably disposed on said infeed conveyor at a predetermined interval from an adjacent infeed tray.

3. The continuous flow transfer apparatus of claim 2 wherein said intermediate containers are fixedly attached to said moving transfer conveyor at said predetermined interval from an adjacent intermediate container.

4. The continuous flow transfer apparatus of claim 2 wherein each cartridge means is releasably attached to said discharge conveyor at said predetermined interval from an adjacent cartridge means.

5. The continuous flow transfer apparatus of claim 1 wherein each said infeed tray advances in an inverted position for at least a portion of the time each said infeed tray is advanced by said infeed conveyor.

6. The continuous flow transfer apparatus of claim 1 wherein each said cartridge means advances in an inverted position for at least a portion of the time each said cartridge means is advanced by said discharge conveyor.

7. The continuous flow transfer apparatus of claim 1 wherein said infeed trays and corresponding intermediate containers nestingly communicate with each other as said documents are deposited from each said infeed tray into an intermediate container.

8. The continuous flow transfer apparatus of claim 1 wherein each said intermediate container and corresponding cartridge means nestingly communicate with each other as said documents are deposited from each said intermediate container into a corresponding cartridge means.

9. The continuous flow transfer apparatus of claim 1 further comprising:

releasable latch means on said infeed conveyor, means to advance said infeed trays into contact with said infeed conveyor, said releasable latch means engaging each said infeed tray to releasably attach said infeed tray to said infeed conveyor;

said releasable latch means holding said infeed tray to said infeed conveyor at least until the documents in said infeed tray are deposited into said intermediate container; and said empty infeed tray being released from said infeed conveyor by activation of said latch means.

10. The continuous flow transfer apparatus of claim 1, wherein each said intermediate container includes separating means to separate the documents deposited into each intermediate container into first and second groups of documents.

11. The continuous of claim 10, wherein each said cartridge means includes a first and second cartridge portion, said first group of documents being deposited from said intermediate container into said first cartridge portion, and said second group of documents being deposited from said intermediate container into said second cartridge portion.

12. The continuous flow transfer apparatus of claim 1, further comprising releasable latch means of said discharge conveyor;

means to advance and said cartridge means into contact with said discharge conveyor, said releasable latch means engaging each said cartridge means to releasably attach said cartridge means to said infeed conveyor, said releasable latch means holding said cartridge means to said discharge conveyor until the documents are from intermediate container into said cartridge means; and said cartridge means being released from said infeed conveyor by activation of said latch means.

13. A continuous flow transfer apparatus for transferring documents from an infeed tray to a cartridge for conveyance of the documents in the cartridge to a document processing system comprising:

an infeed section including at least one moving infeed conveyor advancing a plurality of releasably attached infeed trays, each said infeed tray disposed on said infeed conveyor at a predetermined interval from an adjacent infeed tray, each said infeed tray traveling inverted for at least a portion of the time each said infeed tray is advanced by said infeed conveyor;

a moving transfer conveyor section comprising a predetermined number of intermediate containers fixedly attached to an intermediate transfer conveyor, each said intermediate container disposed at said predetermined interval from an adjacent intermediate container;

a discharge section comprising at least one discharge conveyor advancing a plurality of releasably attached cartridge means, each said cartridge means disposed at said predetermined interval from an adjacent cartridge means, each said cartridge means traveling inverted for at least a portion of the time each said cartridge means is advanced by said discharge conveyor;

said intermediate containers being of sufficient size to nestably communicate with an infeed tray or cartridge means;

said transfer conveyor section positioned between said infeed section and said discharge section such that as said intermediate containers are advanced by said intermediate transfer conveyor, each of said intermediate containers advances to a first position adjacent and nestably communicating with an infeed tray releasably disposed on said infeed conveyor to cause documents in each said infeed tray to be deposited in a corresponding intermediate container as said infeed tray moves to an inverted position;

said intermediate container containing said documents being advanced by said intermediate transfer conveyor to a second position adjacent an inverted cartridge means releasably attached to said discharge conveyor, said intermediate container and said cartridge means nestably communicating with each other, causing said documents in said intermediate container to be deposited into said cartridge means as said cartridge means advances from an upright position to an inverted position;

means to release each said cartridge means containing documents from said discharge conveyor and advance said cartridge means containing documents away from discharge section; and means to release each said infeed tray from said infeed conveyor and advance said infeed tray away from said infeed section.

14. A continuous flow transfer apparatus for transferring documents from a cartridge to an output tray for conveyance of the documents from a document processing system comprising:

a moveable infeed conveyor;

means to advance a plurality of cartridges for containing documents to said infeed conveyor and releasably attach each of said cartridges to said infeed conveyor;

a moving transfer conveyor to which intermediate containers are fixedly attached;

said documents being deposited from each of said cartridges into an intermediate container as each cartridge containing said documents is advanced to an inverted position adjacent an intermediate container;

said documents being deposited from each intermediate container into an output tray as each said intermediate container is advanced to an inverted position adjacent said output tray;

a moveable discharge conveyor, said output tray being releasably attached to said discharge conveyor, and means to release said output tray into which said documents have been deposited from said discharge conveyor and advanced said output tray and said documents away from said discharge conveyor.

15. The continuous flow transfer apparatus of claim 14 wherein each said cartridge is releasably disposed on said infeed conveyor at a predetermined interval from an adjacent cartridge.

16. The continuous flow transfer apparatus of claim 15 wherein said intermediate containers are fixedly attached to said moving transfer conveyor at said predetermined interval from an adjacent intermediate container.

17. The continuous flow transfer apparatus of claim 15 wherein each output tray is releasably attached to said discharge conveyor at said predetermined interval from an adjacent output tray.

18. The continuous flow transfer apparatus of claim 14 wherein each said cartridge advances in an inverted position for at least a portion of the time each cartridge is advanced by said infeed conveyor.

19. The continuous flow transfer apparatus of claim 14 wherein each said output tray advances in an inverted position for at least a portion of the time said output tray is advanced by said discharge conveyor.

20. The continuous flow transfer apparatus of claim 14 wherein said cartridges and corresponding intermediate containers nestingly communicate with each other as said documents are deposited from each said cartridge into an intermediate container.

21. The continuous flow transfer apparatus of claim 14 wherein said intermediate containers and corresponding output trays nestingly communicate with each other as said documents are deposited from said intermediate containers into said output trays.

22. A continuous flow transfer apparatus for transferring documents from an infeed tray to a first cartridge for conveyance of the documents in the first cartridge to a document processing system and for transferring documents from a second cartridge to an output tray subsequent to processing of said documents by said document processing system, comprising:

a first movable infeed conveyor;

means to advance infeed trays for containing documents to said first infeed conveyor and releasably attach said infeed trays to said first infeed conveyor;

a first moving transfer conveyor to which first intermediate containers are fixedly attached;

said documents being deposited into a first intermediate container as an infeed tray containing said documents is advanced to an inverted position adjacent a first intermediate container;

said documents being deposited from said intermediate container into a first cartridge means as each said first intermediate container is advanced to an inverted position adjacent said cartridge means;

a first movable discharge conveyor, said first cartridge means being releasably attached to said first discharge conveyor; and means to release said first cartridge means into which said documents have been deposited from said first discharge conveyor and advance said first cartridge means and said documents away from said first discharge conveyor to said document processing system.

23. The continuous flow transfer apparatus of claim 22 wherein the document processing system includes second cartridge means for receiving documents subsequent to processing of said documents by said document processing system;

a second moveable infeed conveyor;

means to advance said second cartridge means from said document processing system to said second infeed conveyor and releasably attach said second cartridge means to said second infeed conveyor;

a second moving transfer conveyor to which second intermediate containers are fixedly attached;

said documents being deposited from each of said second cartridge means into a corresponding second intermediate container as each second cartridge means containing said documents is advanced to an inverted position adjacent a second intermediate container;

said documents being deposited from each second intermediate container to an output tray as each said second intermediate container is advanced to an inverted position adjacent a corresponding output tray;

a second moveable discharge conveyor, said output tray being releasably attached to said a second discharge conveyor; and means to release said output tray from said second discharge conveyor and advance said output tray away from said second discharge conveyor.

* * * * *